US005204191A

United States Patent [19]

Dubois et al.

[11] Patent Number: 5,204,191

[45] Date of Patent: Apr. 20, 1993

[54] COATING MATERIALS FOR METAL ALLOYS AND METALS AND METHOD

[75] Inventors: Jean-Marie Dubois, Pompey; Pierre Weinland, Houdemont, both of France

[73] Assignee: Centre National de la Recherche Scientifique, Paris, France

[21] Appl. No.: 816,559

[22] Filed: Jan. 6, 1992

Related U.S. Application Data

[63] Continuation-in-part of Ser. No. 474,747, Apr. 3, 1990, abandoned.

[30] Foreign Application Priority Data

Aug. 4, 1988 [FR] France ..... 88 10559

[51] Int. Cl.[5] ..... B32B 15/20; C22C 21/00

[52] U.S. Cl. ..... 428/650; 420/538; 148/438; 148/439; 427/405; 384/912; 126/390

[58] Field of Search ..... 428/650, 651, 652, 653, 428/654; 420/538, 550; 148/438, 442, 403, 439; 126/390; 427/405; 384/912

[56] References Cited

U.S. PATENT DOCUMENTS 4,347,076 8/1982 Ray et al. ..... 420/550

4,595,429 6/1986 Le Caer et al. ..... 148/438

4,710,246 12/1987 Le Caer et al. ..... 148/438

FOREIGN PATENT DOCUMENTS 100287 2/1984 European Pat. Off. .

*Primary Examiner*—John Zimmerman

*Attorney, Agent, or Firm*—Foley & Lardner

[57] ABSTRACT

The invention relates to materials for coating metal alloys or metals, which materials are intended to improve the performance of said alloys or metals.

These materials have a composition which corresponds to the general formula $Al_aCu_bFe_cX_dI_e$, wherein X represents one or more elements chosen from V, Mo, Ti, Zr, Nb, Cr, Mn, Ru, Rh, Ni, Mg, W, Si and the rare earths, and I represents the inevitable manufacturing impurities, $e \leqq 2$, $14 \leqq b \leqq 30$, $7 \leqq c \leqq 20$, $O \leqq d \leqq 10$, with $c+d \leqq 10$ and $a+b+c+d+e=100\%$ of the number of atoms, and they contain at least 40% by mass of an icosahedral quasi-crystalline phase and/or a decagonal quasi-crystalline phase and have a grain size greater than 1,000 nm in the quasi-crystalline phase.

These materials are useful, in particular, for coating copper, aluminium alloys or copper alloys in the manufacture of cooking utensils, anti-friction bearings, anti-wear surfaces and reference surfaces.

23 Claims, 18 Drawing Sheets

COATING MATERIALS FOR METAL ALLOYS AND METALS AND METHOD

This is a continuation-in-Part Application of U.S. patent application Ser. No. 07/474,747 filed Apr. 3, 1990, now abandoned.

The present invention relates to coating materials for metal substrates, the substrates coated with these materials and the applications of these coated substrates.

BACKGROUND OF THE INVENTION

Various metals or metal alloys, for example aluminium alloys, have up to now found numerous applications because of their advantageous properties, and in particular their mechanical properties, good thermal conductivity, light weight and low cost. Thus, for example, cooking utensils and appliances, anti-friction bearings, chassis or supports for equipment and various parts obtained by moulding are known. Copper, because of its excellent thermal conductivity, is also widely used for cooking appliances.

However, these metals or metal alloys have disadvantages linked to their low hardness, low wear-resistance and low resistance to corrosion.

Two essential problems arise with regard to cooking utensils. On the one hand, food has a tendency to stick to aluminium alloy surfaces during cooking. On the other hand, it is difficult to clean cooking devices having surfaces of insufficient hardness, (for example aluminium alloy grill pans). This type of device is easily cleaned by scraping. Such a procedure is, however, difficult to use for alloy surfaces of low hardness, because it leads to rapid deterioration in the condition of the surface.

Copper cooking utensils which traditionally have an internal coating of tin are also known. This coating, although it is particularly suitable for contact with food, nevertheless has the disadvantage of rapidly deteriorating due to its ductility.

Various solutions have been proposed to try to resolve these problems. One of the solutions consists in replacing aluminium alloys with other materials, for example steels, which may be stainless or provided with metal coatings. The advantages associated with good thermal conductivity are then lost. In addition, coatings have been proposed to prevent food sticking, for example Teflon coatings. However, such coatings resist scraping less well than the aluminium alloy substrate itself, and their thermal stability is relatively low.

Various attempts have been made to obtain improved aluminium alloys. Thus, European Patent 100287 describes a family of amorphous or microcrystalline alloys having an improved hardness, which are usable as reinforcing elements for other materials or for obtaining surface coatings which improve resistance to corrosion or wear. But a large number of the alloys described in this patent have a major disadvantage since they are subjected to a temperature greater than 200° C. during use. In fact, they are not stable to heat, and during heat treatment, in particular the treatment to which they are subjected during deposition on a substrate, they change their structure: return to the microcrystalline state in the case of essentially amorphous alloys, increase in particle size in the case of essentially microcrystalline alloys which initially have a particle size of less than one micron. This change in crystalline or morphological structure leads to a change in the physical characteristics of the material which essentially affects its density. This results in the appearance of micro-cracks, and hence brittleness, which interfere with the mechanical stability of the deposits. See also, U.S. Pat. Nos. 4,595,429 and 4,710,246 by LeCaër.

Metal alloys have also been used as heat barriers.

Heat barriers are assemblies of one or more materials intended to limit heat transfer to or from equipment parts and components in many domestic or industrial appliances. There may be mentioned, for example, the use of heat barriers in heating or cooking appliances, smoothing irons where the hot part is attached to the body and where there is heat insulation; in automobiles, in a number of points such as the turbo-compressor, the muffler, the insulation of the passenger compartment, and the like; in aeronautics, for example in the rear part of compressors and jet engines.

Heat barriers are sometimes employed separately in the form of a screen, but very frequently they are directly associated with the source of heat or with the part to be protected, for reasons of mechanical strength. Thus, use is made of sheets of mica, ceramic plates and the like in domestic electrical appliances by adapting them by screwing or adhesive bonding, or of sheets of agglomerated glass wool which are supported by metal sheeting. A particularly advantageous process for attaching a heat barrier to a part, in particular to a metal part, consists in depositing onto a substrate the material constituting the barrier in the form of a layer of specified thickness using a thermal deposition technique such as, for example, plasma deposition.

It is very often recommended to combine the heat barrier with other materials which are also deposited as a layer by thermal deposition. These other materials may be intended to provide the barrier with protection against external attacks, for example mechanical impacts, a corrosive environment, and the like, or may be used as a primer for bonding to the substrate.

The material most frequently employed in aeronautics to form heat barriers is yttriated zirconia, which withstands very high temperatures. The deposition of zirconia is carried out by plasma deposition according to a conventional technique starting with the powdered material. The zirconia exhibits a very low thermal diffusivity ($\alpha = 10^{-6} m^2/s$). However, it has a relatively high specific mass $\rho$, and this is a disadvantage in the case of some applications; in addition, some of its mechanical properties, such as hardness and resistance to wear and to abrasion, are poor.

Other materials are employed as a heat barrier. There may be mentioned alumina, which has a specific mass which is lower than that of zirconia, and a diffusivity and a specific heat which are higher than that of zirconia, but whose mechanical properties are not satisfactory. There may also be mentioned stainless steels and some refractory steels, which offer thermal insulation properties, but which have a high specific mass.

OBJECT OF THE INVENTION

The inventors have now discovered that certain of the alloys among those in European Patent 100287 have a particular structure which is thermally stable and which are superior heat barriers.

The object of the present invention is to provide a coating material allowing the good properties of certain metal substrates which are normally used, to be retained while eliminating the disadvantages associated with their surfaces. The materials which constitute these coatings have an improved hardness, a lower coefficient of friction and a good stability to temperatures greater than 300° C., which is necessary, in particular, for cooking utensils.

DETAILED DESCRIPTION

The coating materials according to the invention are characterized in that they correspond to the formula $Al_aCu_bFe_cX_dI_c$ wherein X represents one or more elements chosen from V, Mo, Ti, Zr, Nb, Cr, Mn, Ru, Rh, Ni, Mg, W, Si and the rare earths, I represents the inevitable manufacturing impurities, $e \leqq 2$, $14 \leqq b \leqq 30$, $7 \leqq c \leqq 20$, $0 \leqq d \leqq 10$, with $c+d \leqq 10$ and $a+b+c+d+e=100\%$ of the number of atoms, and in that they contain at least 40% by mass of a quasi-crystalline phase and have a mean grain size on the crystalline phase greater than 1,000 nm.

A quasi-crystalline phase is understood to be a phase or a metal compound which, if studied by diffraction, reveals the existence of rotational symmetries which are normally incompatible with the translational symmetry, that is to say the existence of axes of the order 5, 8, 10 or 12. The quasi-crystalline icosahedral phases, which are solid metallic phases which diffract electrons like a single crystal, but which have an m35 symmetry group with respect to a point which is incompatible with lattice translations, can be cited as an example of such phases or compounds. (Cf. D. Schechtman, I. Blech, D. Gratian, J.W. Cahn, "Metallic Phase with Long-Range Orientational Order and No Translational Symmetry," *Physical Review Letters*, Vol. 53, No. 20, 1984 pages 1951–1953). The decagonal quasi-crystalline phases, which are solid metallic phases which diffract electrons like a single crystal, but which have a 10/m or 10/mm symmetry group with respect to a point, a long-range order and a one-dimensional translational symmetry, may also be mentioned. (Cf. L. Bendersky, "Quasicrystal with One Dimensional Translational Symmetry and a Tenfold Rotation Axis", *Physical Review* Letters, Vol. 55 No. 14, 1985 page 1461–1463). A quasi-crystalline phase is further intended to mean the approximating phases or approximating compounds which are true crystals insofar as their crystallographic structure remains compatible with the symmetry of translation but which on the electron diffraction negative exhibit diffraction patterns whose symmetry is close to the axes of rotation 5, 8, 10 or 12.

Among these phases there may be mentioned:

- the orthorhombic approximating phase as defined in C. Dong, J.M. Dubois, *J. Materials Science*, 26 (1991), 1647;
- the R rhombohedral approximating phase as defined in M. Audier and P. Guyot, 3rd Int. Meeting on Quasicrystals, eds. J. Yacaman, World Scientific, Singapore, 1990.

The stable quasi-crystalline phases of the coating materials according to the invention grow in a manner which is analogous to normal crystals. As a consequence they behave like defined compounds and have transition points which are situated at higher temperatures than those of the eutectics of the current binary aluminium alloys $Al/Al_2Cu$ (547° C.), Al/Si (577° C.), $Al/Al_3Fe$ (655C), for example. The result is a stability which exists beyond or up to the region of these eutectic points.

The materials according to the invention are obtained by conventional processes which involved slow cooling. That is, conventional metallurgical processes are slow cooling processes, where the cooling rate is less than about 500° C./min. For example, a material according to the invention can be made from pure (99.5% or better) elements by mixing the various elements in the proportions corresponding to the stoichiommetry of the desired material, then fusing the mixture in a graphite crucible under argon at a pressure of $2 \times 10'$ Pa in a HF oven. If necessary, ultra-rapid cooling of the material can be carried out after fusion (a process known as "melt spinning"). This process allows better homogeneity of the coating material to be obtained.

Aluminium alloys, copper alloys and copper can be used as substrate. The coating materials according to the invention are particularly useful for commercial aluminium alloys, and in particular for the alloys known as "food grade" or the alloys known as "casting alloys" and for copper.

The use of the materials according to the invention as coatings for various substrates is carried out by different processes depending on the desired result.

For example, if a coating with a high degree of open porosity is desired, the material according to the invention is deposited on the substrate by spraying droplets of the material. A powder torch, such as the "Pistolet Thermospray type 5P" sold by Metco Inc., can be used for this purpose. Before spraying, the material according to the invention in the form of a solid mass is ground and sieved to obtain a powder, the particles of which have a size of between about 0.02 mm and 0.2 mm, preferably less then 0.074 mm. If a low degree of open porosity is desired, deposition of the material according to the invention will be carried out by a vapor-phase process, for example by cathodic sputtering, or using a plasma torch fed with a powder as indicated above.

For certain applications, it can be useful to eliminate or reduce the degree of open porosity at the surface. Such a result is obtained by:

- shot blasting, for example using steel microbeads having a diameter of 0.5 to 1 mm. A surface with zero open porosity is thus obtained, without loss of hardness, increase in the coefficient of friction or loss of adhesion at the substrate-coating interface.
- polishing, for example using metallographic paper, on condition that the closed porosity of the coating is negligible.
- surface melting.

To obtain a level of open porosity in the neighborhood of zero directly, a supersonic jet torch, which accelerates the powder of the material according to the invention to speeds of between Mach 6 and Mach 14 can be used.

The materials of the present invention can also be employed for forming components for protecting a substrate against heat, in the form of a heat barrier or in the form of a bonding primer in the case of heat barriers consisting of conventional materials. They exhibit good thermal insulation properties, good mechanical properties, a low specific mass, a good resistance to corrosion, above all to oxidation, and easy processability.

Materials containing at least 80% of quasi-crystalline phase are preferably employed.

The materials of the present invention, which can be employed for the production of components for protecting against heat according to the present invention exhibit thermal diffusivity at values close to $10^{-6}\,m^2/s$, which are very comparable with the thermal diffusivity of zirconia. Bearing in mind the lower specific mass $\rho$ of these materials, the thermal conductivity $\lambda = \alpha\rho C_p$ in the neighborhood of room temperature does not differ significantly when compared with that of zirconia. The quasi-crystalline alloys of the present invention are therefore substitutes which are recommended for replacing many heat barrier materials, and in particular zirconia, in comparison with which they offer the advantages of low specific mass, excellent mechanical properties with regard to hardness and improved resistance to wear, to abrasion, to scratching and to corrosion.

The diffusivity of the materials forming the components for protecting against heat of the present invention is reduced when the porosity of the materials increases. The porosity of a quasi-crystalline alloy can be increased by an appropriate heat treatment. Thus, for example, the alloy $Al_{63.5}Cu_{24}Fe_{12.5}$, when produced in the crude state, has a porosity of the order of 3%, as measured by conventional image analysis on a metallographic section. After a heat treatment of three hours at 850° C. the porosity is of the order of 8%. It is particularly advantageous to employ quasi-crystalline alloys which have a porosity of more than 10% for producing components for protecting against heat.

The materials forming the components for protecting against heat of the present invention may contain a small proportion of thermally conductive particles, for example of crystals of aluminum metal. The thermal conduction of the material will be predominantly controlled by the conductive properties of the matrix so long as the particles do not coalesce, that is to say so long as their proportion per unit volume remains below the percolation threshold. In the case of approximately spherical particles which have a narrow radius distribution this threshold is situated in the region of 20%. This condition implies that the material forming the component for protecting against heat should contain at least 80% by volume of quasi-crystalline phases as defined above.

At temperatures below approximately 700° C. the components for protecting against heat can be employed as heat barriers. Such temperature conditions correspond to most of the domestic applications or those in the automobile field. Moreover, they are highly capable of with-standing the stresses due to the expansion of the support and their expansion coefficient is intermediate between that of metal alloys and that of insulating oxides. In the case of temperatures above approximately 600° C. the quasi-crystalline alloys forming the heat barriers may preferably contain stabilizing elements chosen from W, Zr, Ti, Rh, Nb, Hf and Ta. The content of stabilizing element is less than or equal to 2% based on the number of atoms.

The heat barriers of the present invention may be multilayer barriers which have an alternation of layers of materials which are good heat conductors and layers of materials which are poor conductors (quasi-crystalline alloys). Such structures form, for example, abradable heat barriers.

For applications in which the temperatures reach values higher than approximately 600° C. the components for protecting against heat of the present invention may be employed as a bonding primer for a layer used as a heat barrier and consisting of a material of the prior art, such as zirconia. In these temperature ranges the materials forming the components for protecting against heat of the present invention become superplastic. They therefore correspond well to the conditions of use required for the production of a bonding primer by being capable themselves of taking part in the insulation of the substrate. Thus, the components for protecting against heat of the present invention can be employed to within a few tens of degrees of the melting point of the material of which they consist. This limit lies in the region of 950° C. to 1200°, depending on the composition.

A component for protecting against heat of the present invention is produced by depositing the material(s) of which it consists as one or more layers on a substrate. The quasi-crystalline material is deposited by a thermal deposition process, for example with the aid of an oxygen-gas torch, a supersonic torch or a plasma torch.

The present invention will be explained in more detail by reference to the non-limiting examples which follow.

The coatings obtained have been characterized by their thickness (T), their degree of open porosity (OP), their adhesion index (AI), their coefficient of friction (CF) their hardness (H) and their quasi-crystalline phase content (QC).

The degree of open porosity (OP) was estimated from scanning microscopy images, obtained using a SEM 505 scanning microscope from Philips.

The adhesion indices (AI) were assigned after fracture during notched bar impact test, in the following manner:

- index A when there is no detachment visible at 10 the substrate/deposit interphase; adhesion is considered to be perfect.
- index B when 3 or more cracks are visible at the substrate/deposit interface, using optical metallography, with a magnification of 50.
- index E when detachment is visible at the substrate/deposit interface.

The coefficient of friction CF was evaluated during a scratch-resistance test using a Vickers diamond indenter. The coefficient of friction CF is equal to tangent $\alpha$, $\alpha$ being the slope of the curve $Ft=f(Fn)$, Ft being the tangential force of scratch-resistance, and Fn being the force applied to the indenter which increases linearly with time.

Hardness ($Hv_{30}$) was determined using a Wolpert V-Testor 2 hardness meter, under a load of 30 grams.

The existence of quasi-crystalline phases is confirmed by X-ray diffraction. X-ray diffraction diagrams were made using a rapid acquisition Siemens diffractometer with a linear wire counter, using colbalt $K_{\alpha l}$ radiation, $\lambda=0.17889$ nm.

The thermal stability of the materials according to the invention was studied by differential scanning calorimetry using a Setaram calorimeter.

BRIEF DESCRIPTION OF THE DRAWINGS

The coatings obtained were characterized and the attached figures illustrate certain characterizations. Thus.

In these diagrams, the diffraction angle 20 is on the abscissa and the number of pulses counted, which corresponds to the intensity, is on the ordinate.

Figure 7:
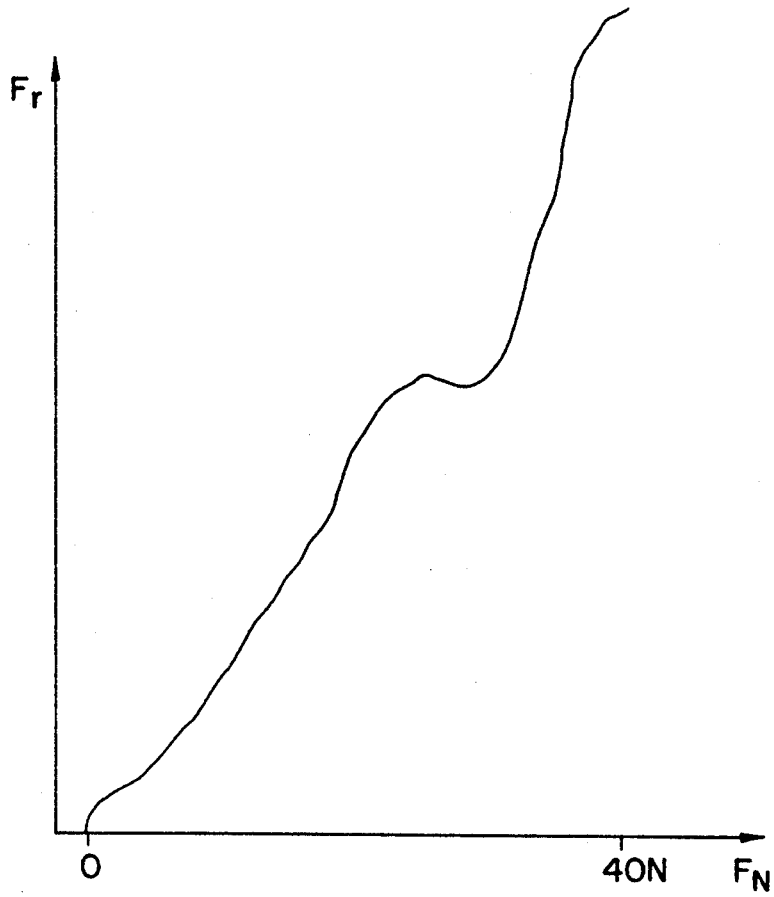
Figure 8:
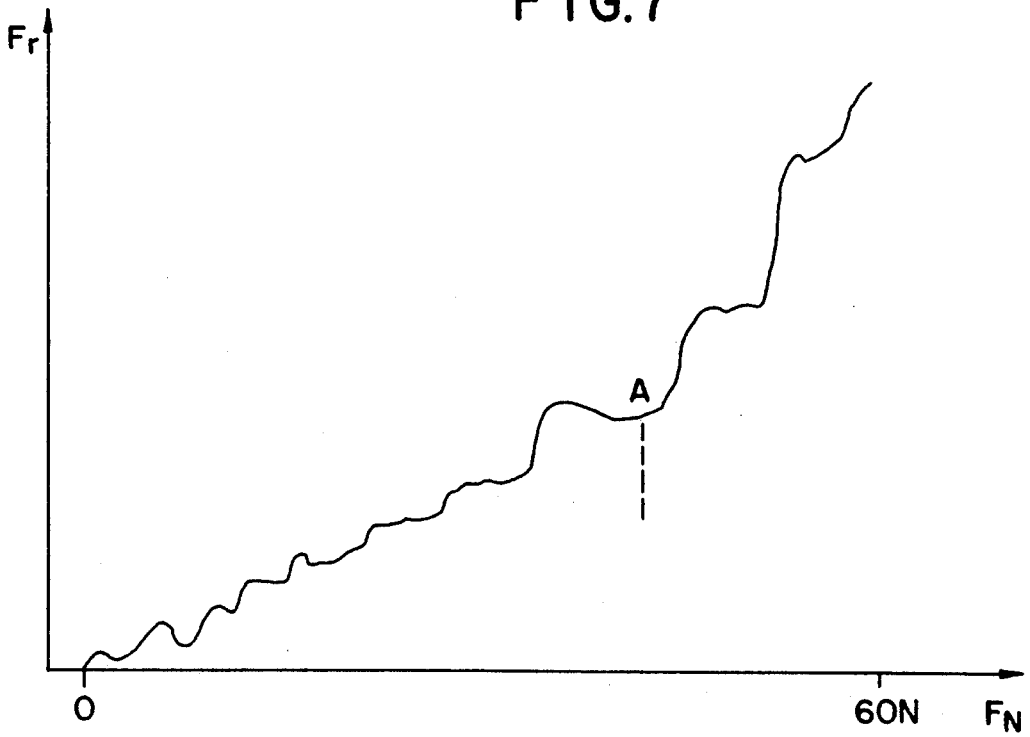
Figure 9:
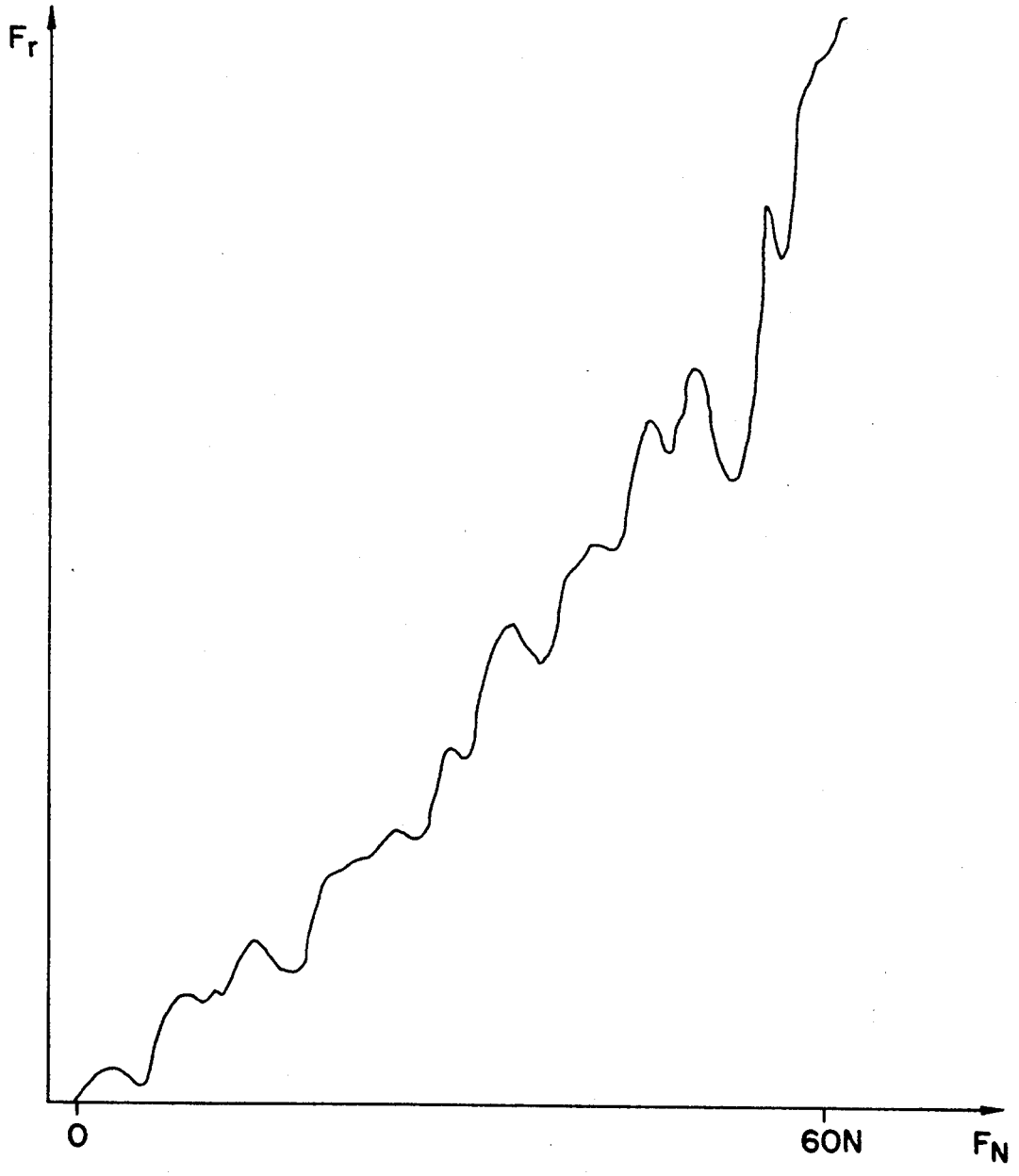

FIGS. 7, 8 and 9 show the curve $Ft=f(Fn)$ obtained during the scratch-resistance test for, respectively, a substrate, a coating according to the invention and a coating according to the prior art.

Figure 10:
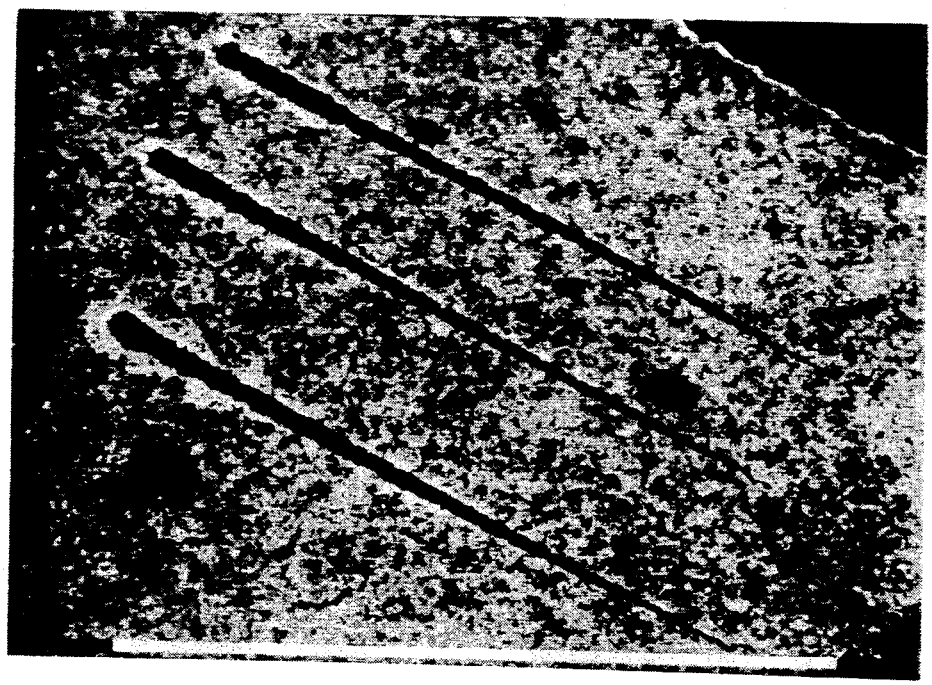

FIG. 10 shows a scanning microscopy image of a coating according to the invention which has three scratches like those made during the scratch-resistance test.

Figure 11:
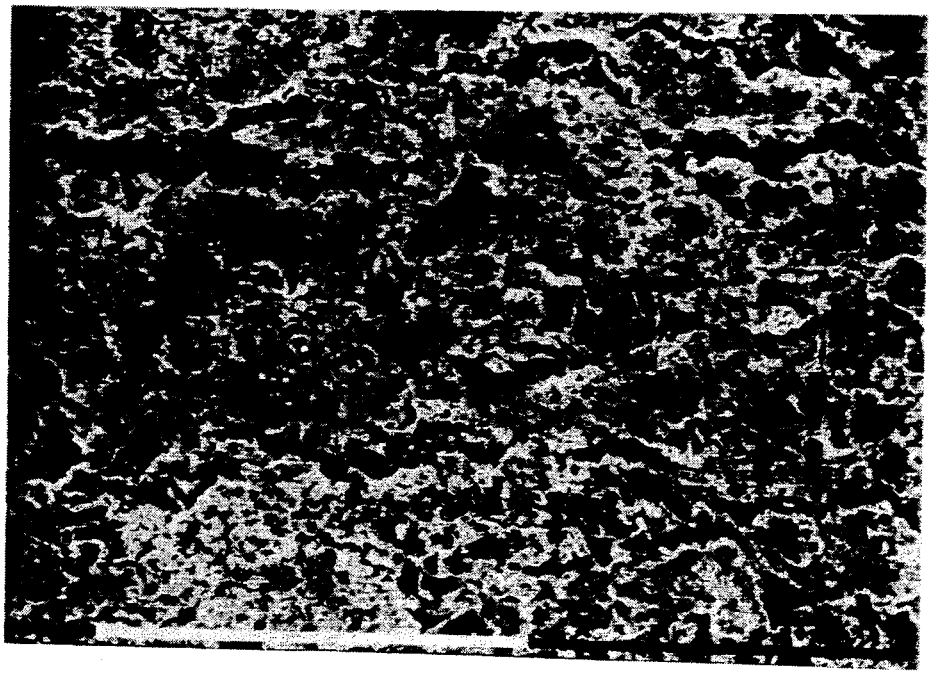
Figure 12:
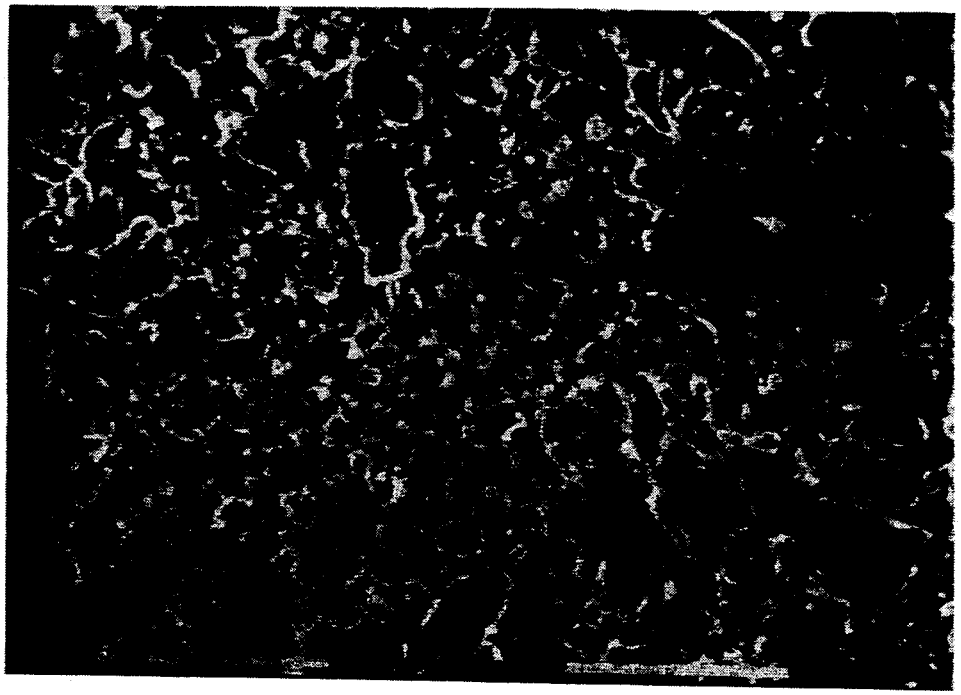
Figure 13A:
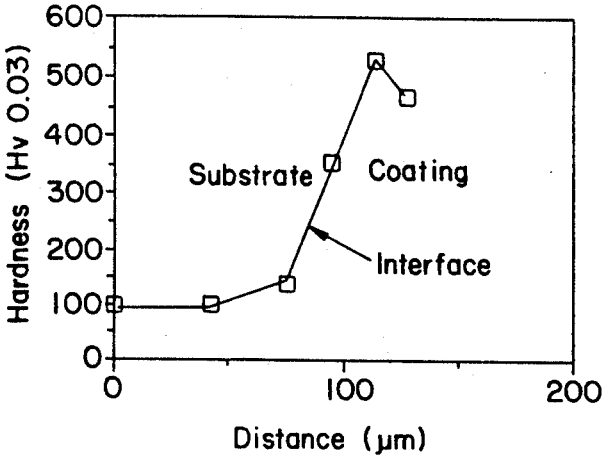
Figure 13B:
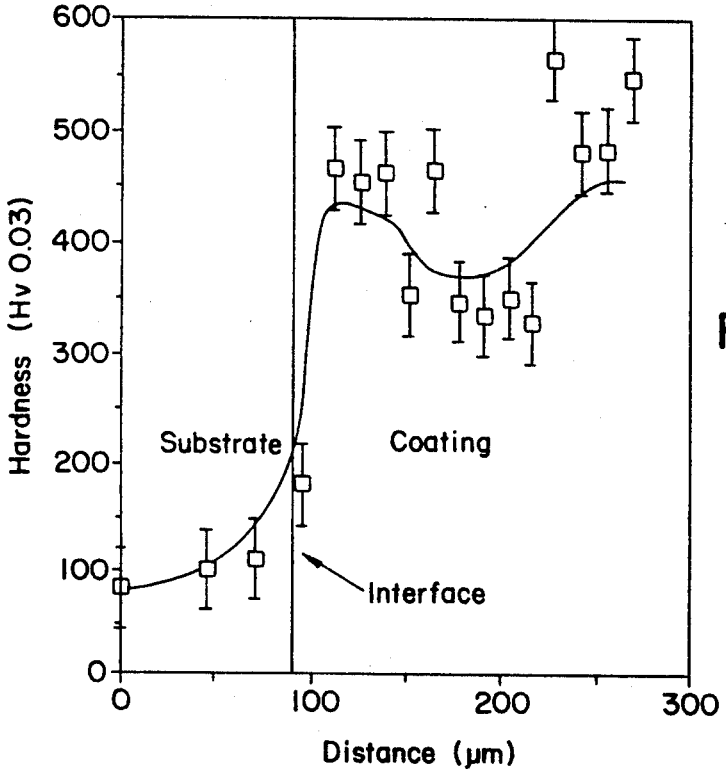
Figure 13C:
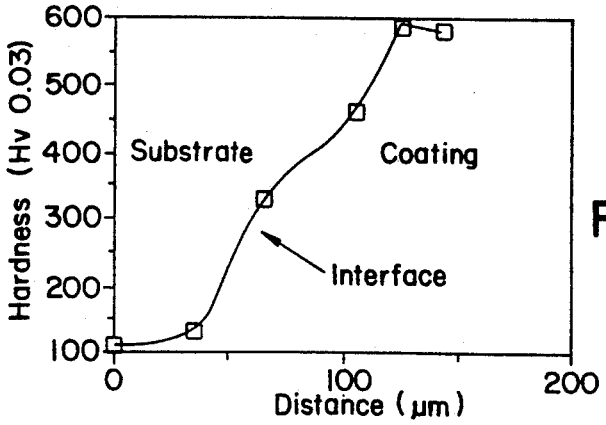
Figure 13D:
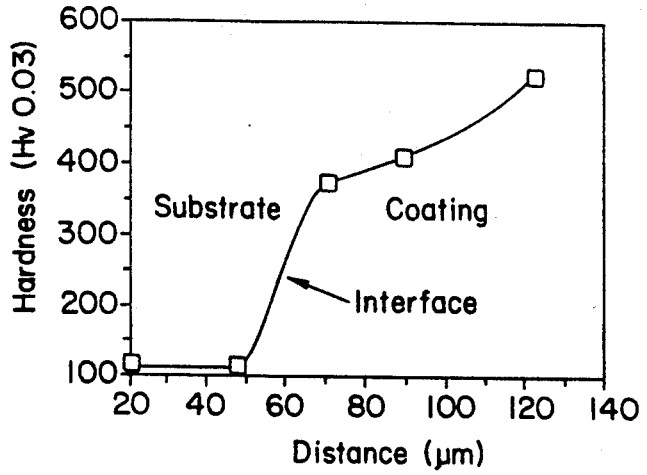
Figure 13E:
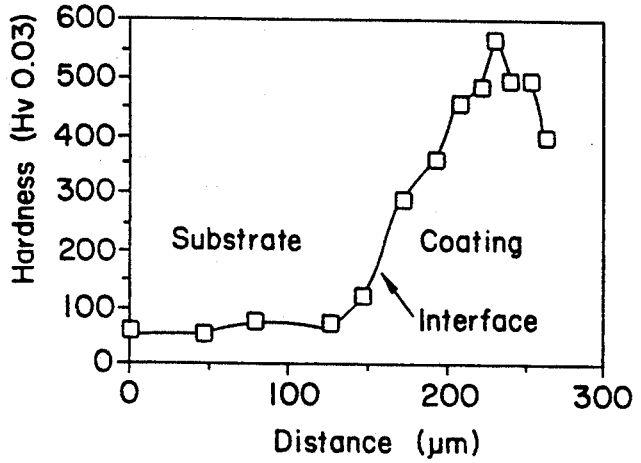

FIGS. 11 and 12 show, respectively, scanning microscopy images for two coatings according to the invention.

FIGS. 13*a* to 13*e* show the variation in hardness for, respectively, the coated substrates R11 to R15, along a straight line perpendicular to the surface of the substrate.

Figure 14:
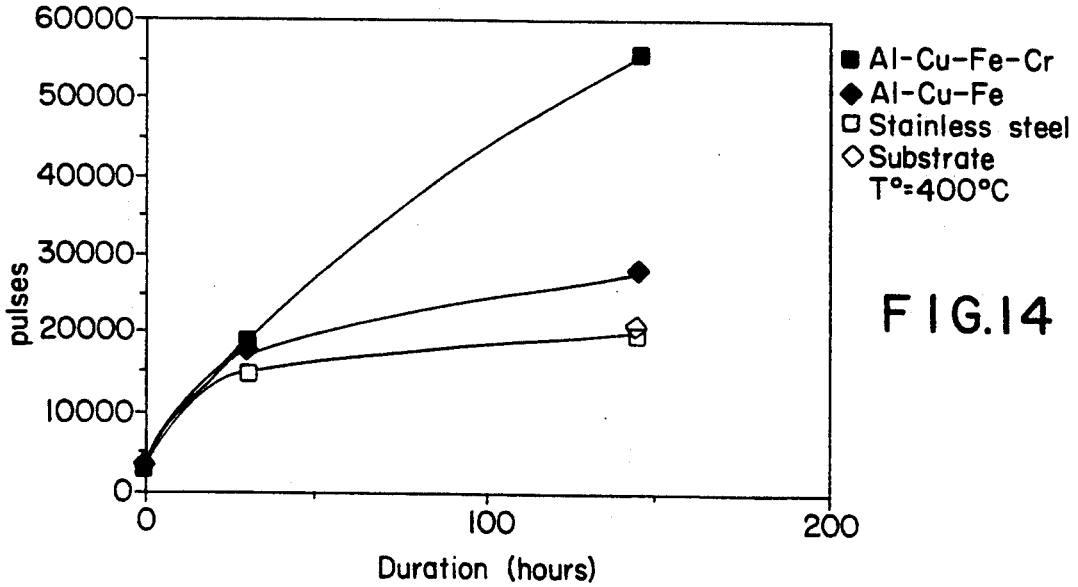

FIG. 14 shows the curve showing the number of pulses received on the analyzer of a Casting probe at constant temperature as a function of time for different substrates.

Figure 15:
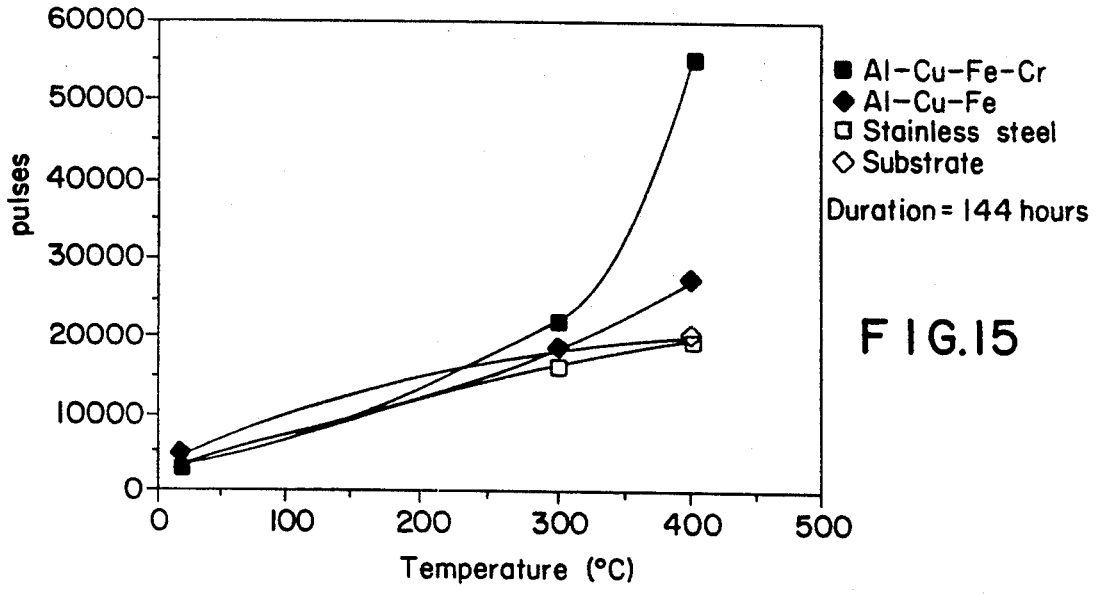

FIG. 15 shows the curve showing the number of pulses received on the analyzer of a Casting probe at a given time as a function of the temperature.

Figure 16:
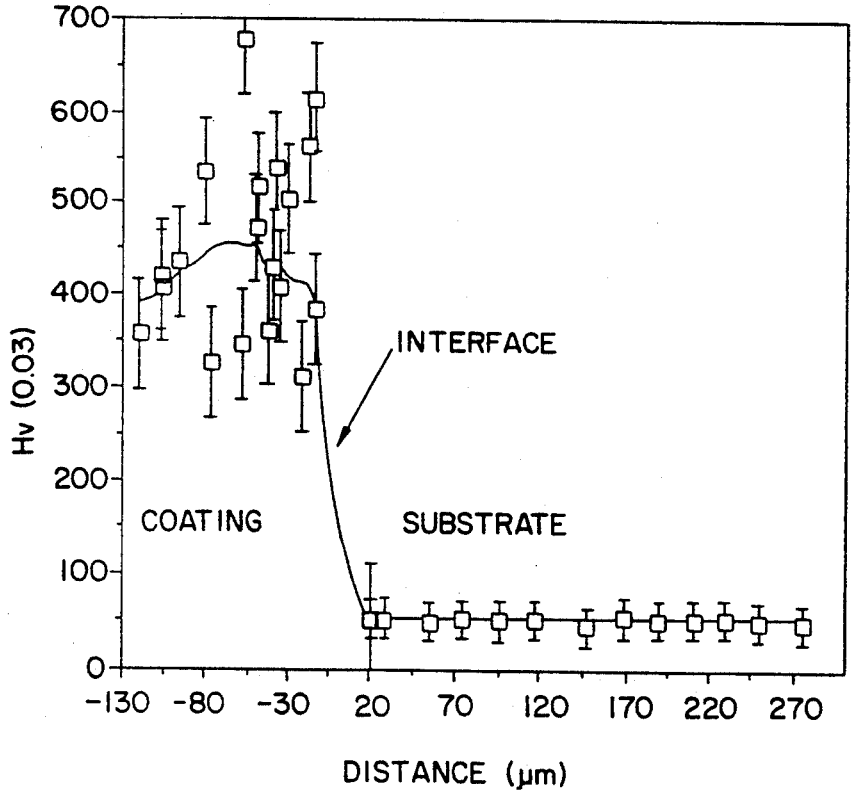
Figure 17B:
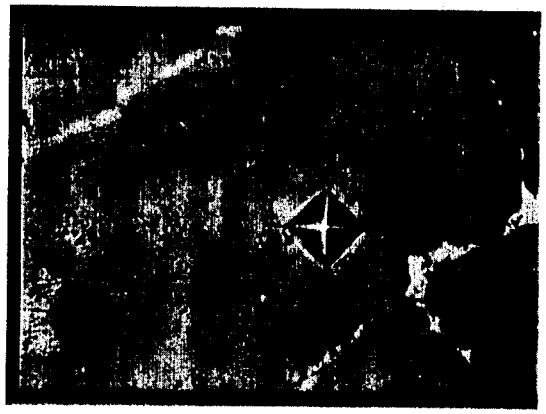
Figure 17D:
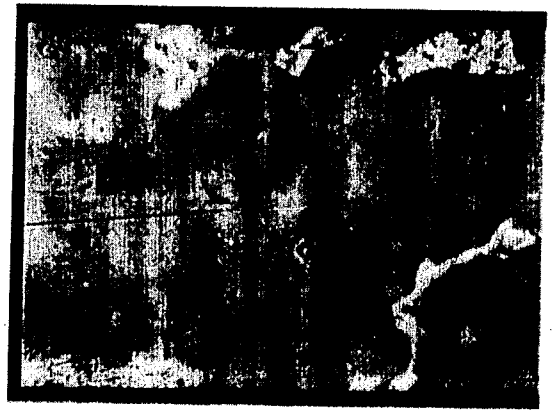
Figure 17A:
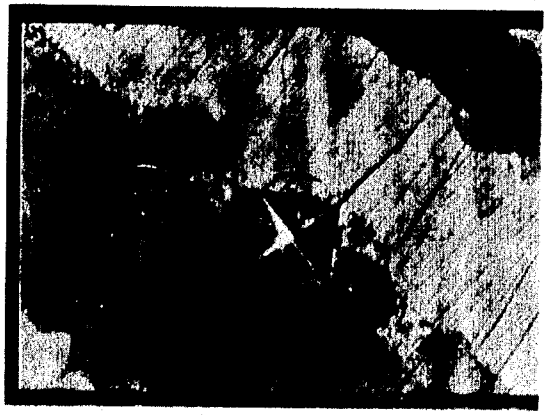
Figure 17C:
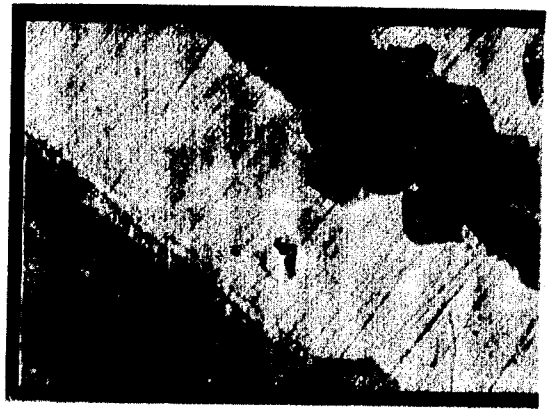

FIG. 16 shows the variation in the hardness of coated substrate R18 of Example 7, along a straight line perpendicular to the surface of the substrate, for different substrates.

FIGS. 17*a*–17*d* show an optical micrography of ingot 279 in the as-cast state (17*a*, 17*c*) and annealed state (17*a*, 17*d*) from Example 8. Vickers indentations are shown, load 400 gr (17*a*, 17*b*) and 30 gr (17*c*, 17*d*) ×500.

Figure 18B:
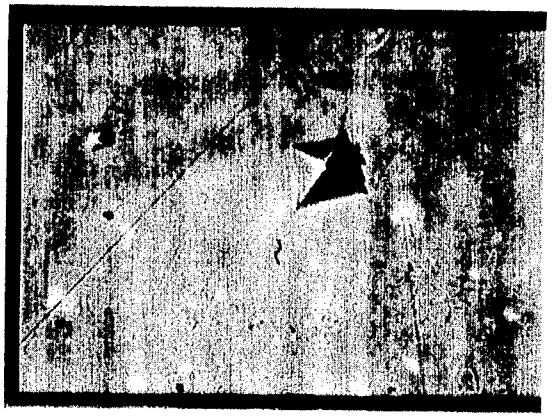
Figure 18A:
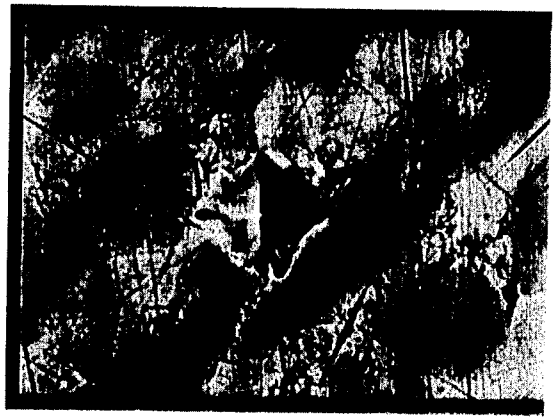

FIGS. 18*a*–18*b* show an optical micrography of ingot 280 in the as-cast state (2*a*) and annealed state (2*b*) from Example 8. Vickers indentations are shown, load 400 gr ×500.

Figure 19B:
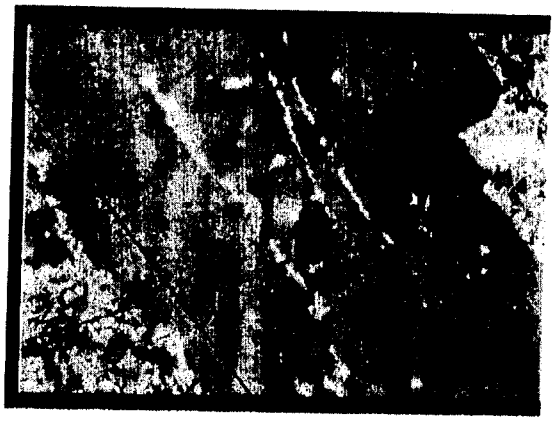
Figure 19A:
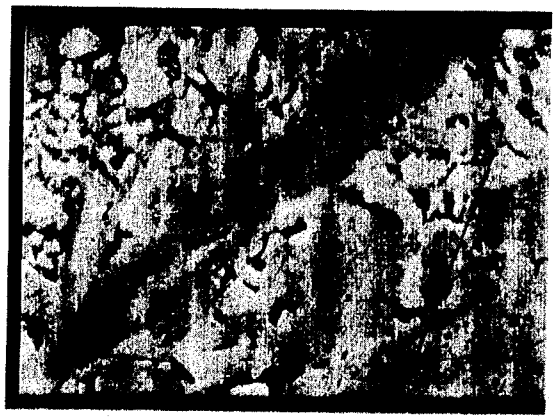

FIGS. 19*a*–19*b* show an optical micrography of ingot 281 in the as-cast state (19*a*) and annealed state (19*b*) from Example 8. Vickers indentations are shown, load 400 gr ×500.

Figure 20:
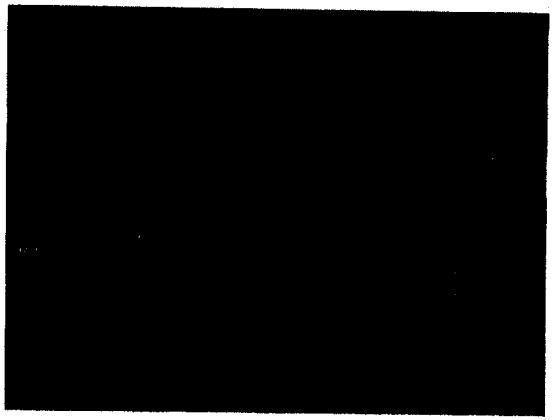

FIG. 20 shows an optical micrography of a melt-spun ribbon 279 (wheel tangential speed 50 m/s) from Example 8. Vickers indentations are shown, load 30 gr ×500.

Figure 21:
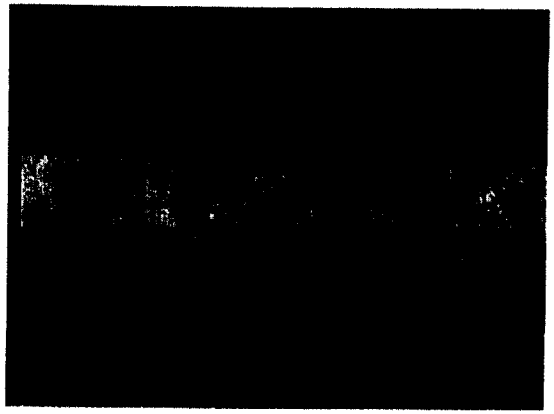

FIG. 21 shows an optical micrography of a melt-spun ribbon 280 (wheel tangential speed 50 m/s) from Example 8. Vickers indentations are shown, load 30 gr ×500.

Figure 22:
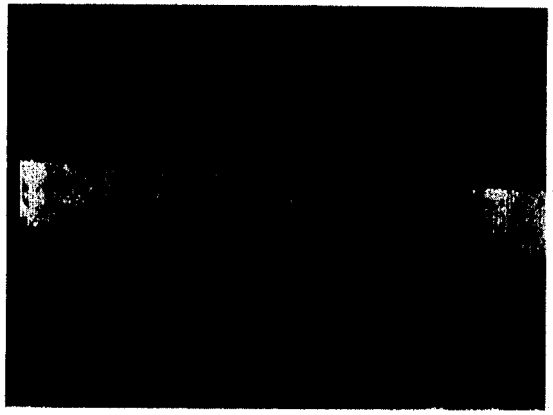

FIG. 22 shows an optical micrography of a melt-spun ribbon 281 (wheel tangential speed 50 m/s) from Example 8. Vickers indentations are shown, load 30 gr ×500.

Figure 23:
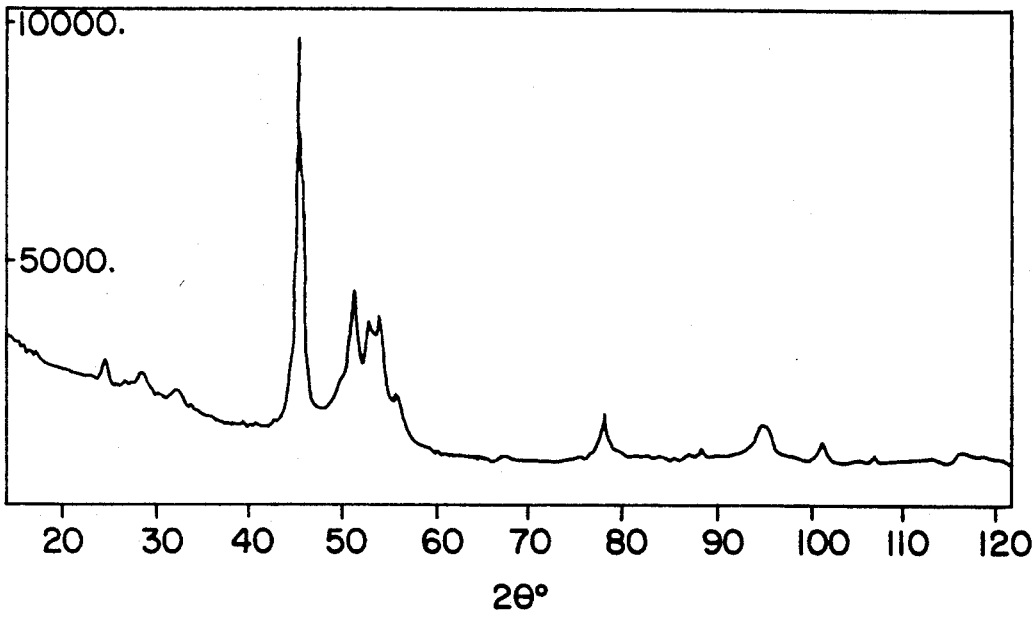

FIG. 23 shows an X-ray diffraction pattern ($\lambda$=0.17789)nm) showing the mixture of microcrystals and amorphous phase obtained in melt-spun ribbon 281 from Example 8.

Figure 24:
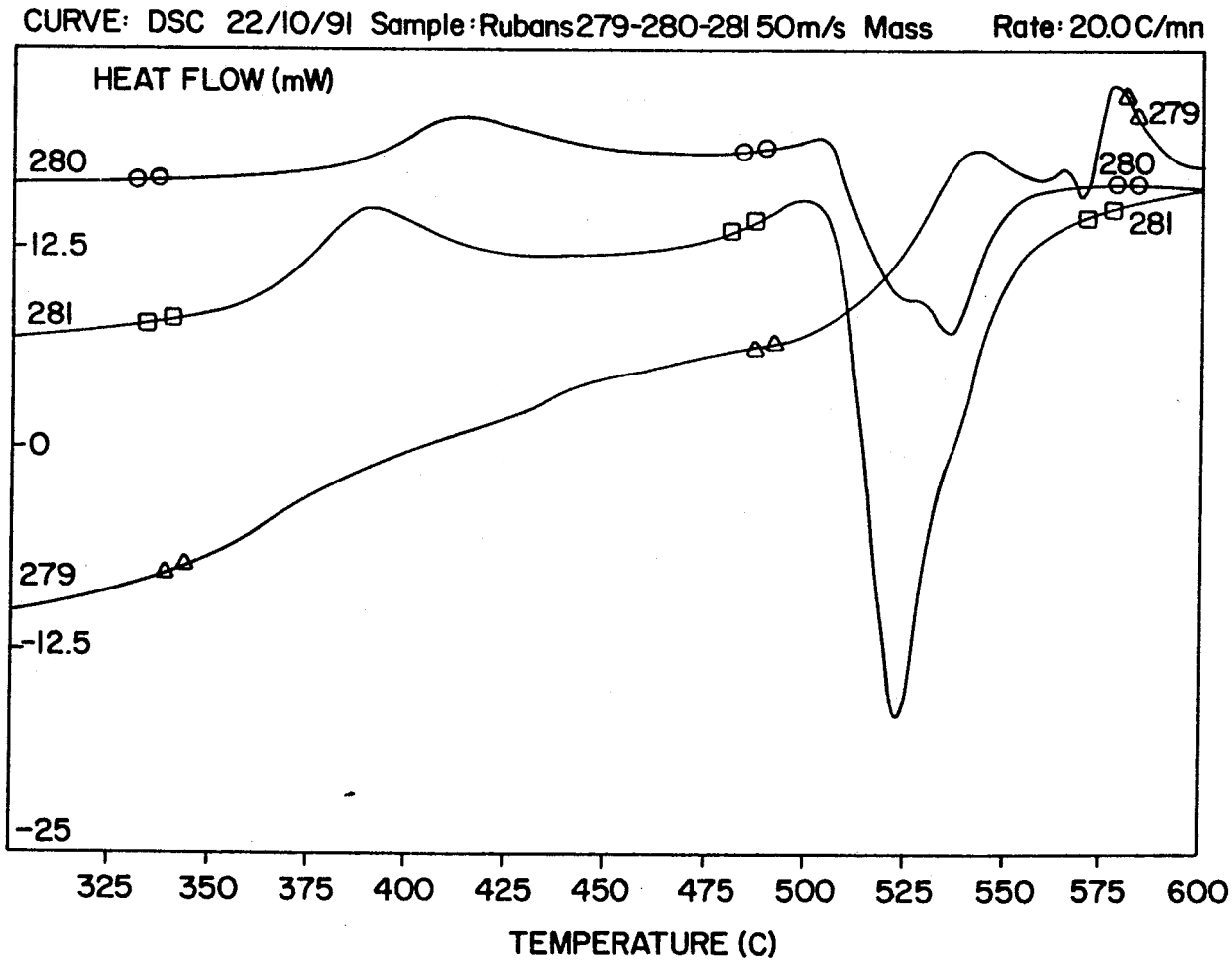

FIG. 24 shows DSC traces for melt-spun ribbon 279, 280, and 281 from Example 8.

Figure 25:
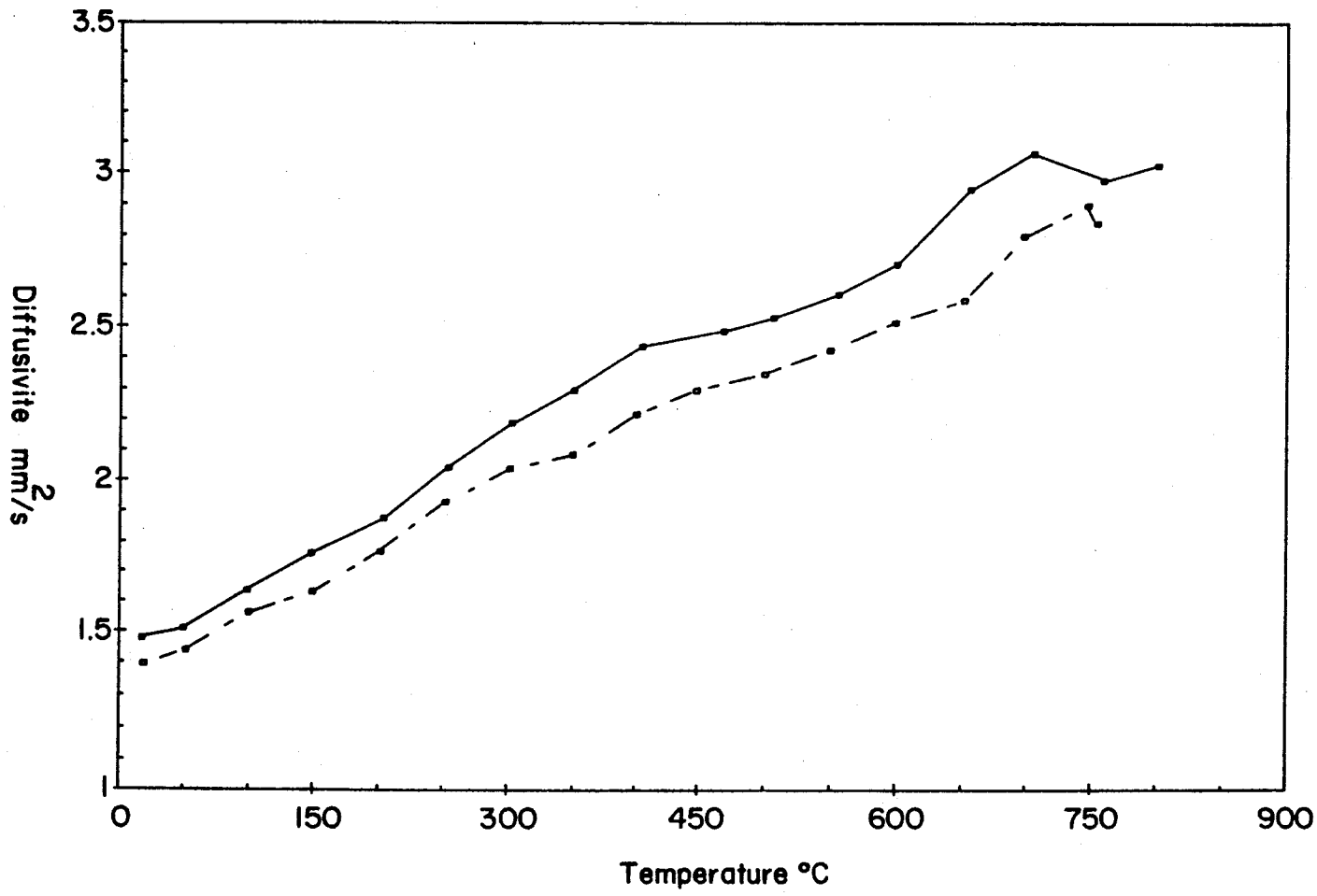

FIG. 25: the measurements recorded on heating the alloy $Al_{65}Cu_{20}Fe_{10}Cr_5$ (alloy 2) are shown using black squares, those recorded on cooling using white squares.

Figure 26:
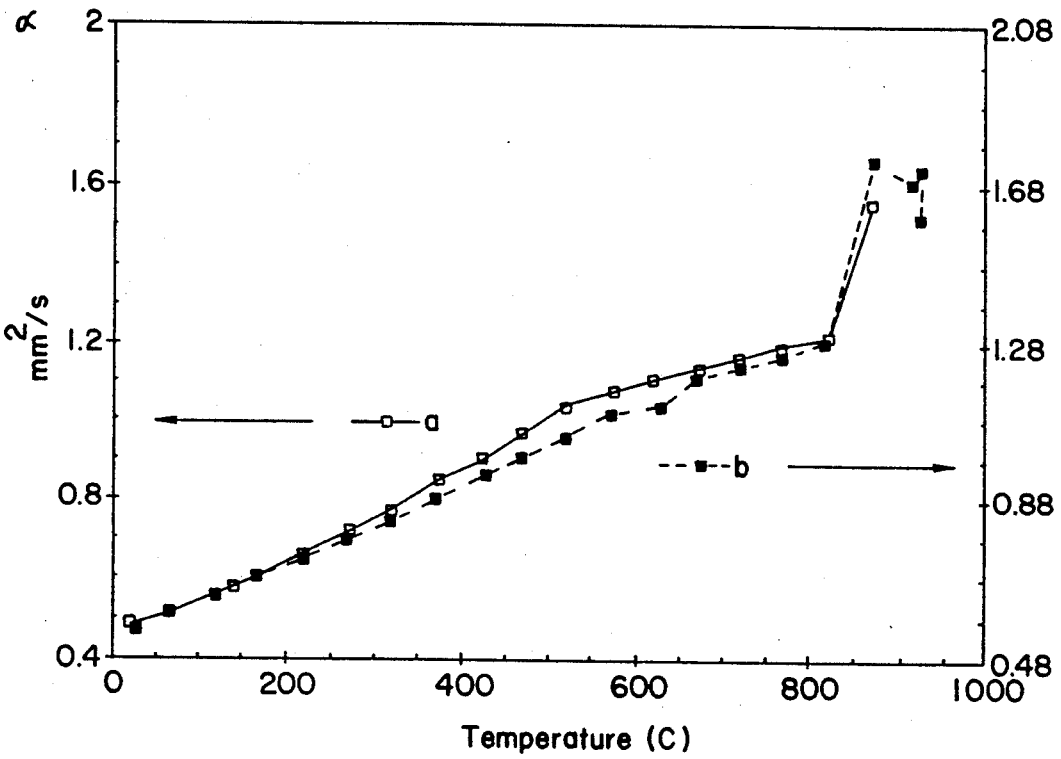

FIG. 26: heating in the case of the alloy $Al_{63.5}Cu_{24}Fe_{12.5}$ (alloy 4) in the state of a rhombohedral approximating composition (a) and of icosahedral phase (b). Above 860° C. the alloy is transformed into a mixture of crystalline phases, hence the increase in $\alpha$, and then melts at about 950° C.

Figure 27:
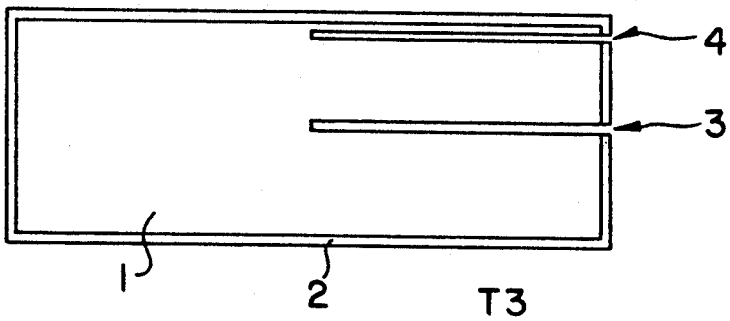

FIG. 27 shows a sample of the copper cylinder type 1 comprising a coating 2 and provided with a central thermocouple 3 and a side thermocouple 4, both being inserted as far as midway of the length of the cylinder.

Figure 28:
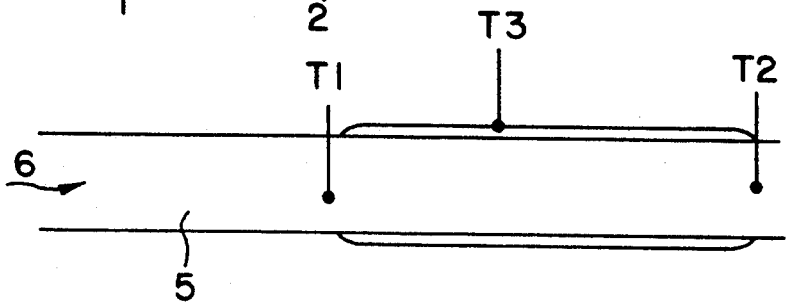

FIG. 28 shows a hollow tube 5 through which a stream of hot air 6 is passed and which is provided with three thermocouples, T1, T2 and T3, respectively.

Figure 29:
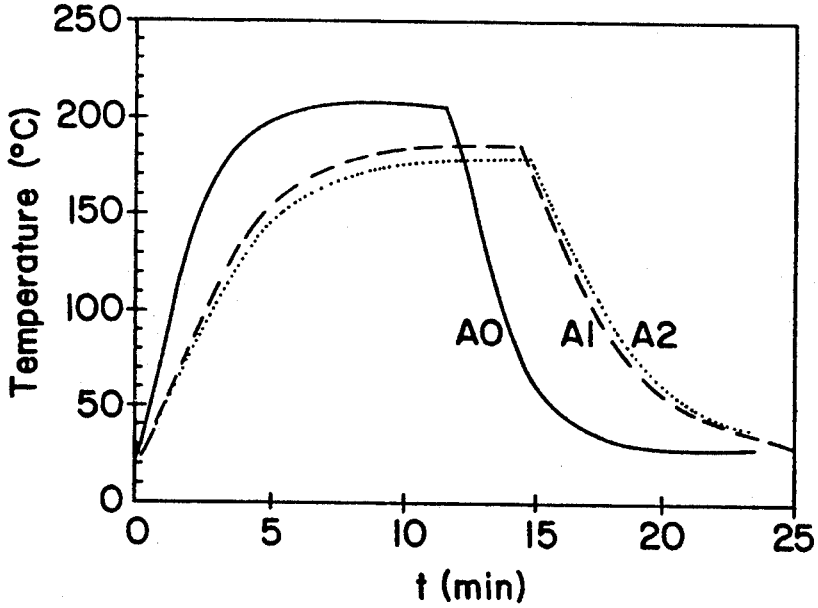

FIG. 29 shows the change in the surface temperature of each of the samples, A0, A1 and A2 as a function of time.

EXAMPLE 1

Preparation of Coating Materials According to the Invention

Various coating materials were prepared by fusion of the constituent elements in stoichiometric proportions corresponding to the desired composition in a graphite crucible using a HF oven under a pressure of $2\times10^4$ Pa of argon. Table 1, below, gives the composition of the materials M1–M5, M9 and M10 prepared.

TABLE 1

| Material | Composition |
|---|---|
| M1 | $Al_{65}Cu_{20}Fe_{15}$ |
| M2 | $Al_{69}Cu_{17}Fe_{10}Mo_1Si_3$ |
| M3 | $Al_{72}Cu_{16}Fe_8Mo_1Si_3$ |
| M4 | $Al_{75}Cu_{14}Fe_7Mo_1Si_3$ |
| M5 | $Al_{68}Cu_{17}Fe_{10}V_5$ |
| M9 | $Al_{65}Cu_{22}Fe_{13}$ |
| M10 | $Al_{65.5}Cu_{18.5}Fe_8Cr_8$ |

EXAMPLE 2

Deposition of Materials M1 to M5 on a Substrate

The substrate was an AU4G aluminium alloy, having a hardness Hv=95±5 and a coefficient of friction CF=1.6.

A crude cast material obtained in the preceding example was ground in a mill using carbon-steel balls. The resulting powder was sieved, and the fraction having a diameter less than 0.074mm was retained.

This fraction was sprayed using a powder torch, the Metco Pistolet Thermospray.

The hydrogen flow rate was 47 1/min and the oxygen flow rate was 28 1/min.

The piece was maintained under an atmosphere of $N_2$ containing 5% $H_2$.

The temperature of the substrate remained below 200° C. during spraying.

The coatings where polished using 1200 grain metallographic paper.

The characteristics of coatings R1 to R7, obtained from materials M1 to M5, are collated in Table 2 below.

TABLE 2

| Coat. | Mat. | T (μm) | OP | AI | CF | H(Hv30) | OC (% by mass) |
|---|---|---|---|---|---|---|---|
| R1 | M1 | 30 ± 10 | 10% | B | 0.5 | 560 | >90% |
| R2 | M1 | 50 ± 10 | 35% | A | 0.5 | 410 | >90% |
| R3 | M1 | 50 ± 10 | 40% | A | 0.5 | 370 | >90% |
| R4 | M2 | 40 ± 10 | 30% | A | | 500 | >80% |
| R5 | M3 | 40 ± 10 | 30% | A | | 480 | >80% |
| R6 | M4 | 50 ± 10 | 40% | B | | 510 | >60% |
| R7 | M5 | 30 ± 10 | 30% | A | 0.55 | 510 | >60% |

For coatings R1, R2 and R3, the residual phases are in too low a proportion to be identified. In coatings R4, R5 an dR6, the residual phase contains a mixture of $Al_2Cu$, $al_7Cu_2Fe$, $Al_6Fe$, Al and Si. In coating R7 the residual phase contains a mixture of $Al_2Cu$ and $al_3V$.

The quasi-crystalline structure of the materials of the invention induces great thermal stability in the coatings obtained.

The first transition temperature Tx of the various materials before deposit, and of the coated substrates obtained, was determined by scanning calorimetry with $\alpha$=10°/min.

Measurement was carried out on the following materials:

materials M1 to M4, materials M1' to M4', respectively of the same composition as M1 to M4, but having undergone rapid solidification by spraying onto a revolving drum (melt spinning). M2', M3' and M4' have a more than negligible proportion of amorphous phase, unlike M1'.

substrate AU4G, coated respectively with the 8 materials above.

For the coated substrates, the temperature Tx determined is that of the substrate, considering the low relative thickness of the coating.

The results for materials M1 to M4 and M1' to M4' are given in Table 3 below.

TABLE 3

| Material | % of amorphous phase (by mass) | Tx |
|---|---|---|
| M1 | ≃0 | >800° C. |
| M2 | ≃0 | >800° C. |
| M3 | ≃0 | >800° C. |
| M4 | ≃0 | >800° C. |
| M1' | ≃0 | >800° C. |
| M2' | ≃10 | 540° C. |
| M3' | ≃20 | 420° C. |
| M4' | ≃40 | 380° C. |

It appears that after deposition on a substrate, the amorphous phase of materials M2' to M4' has disappeared. The coating has a stability which is at least equal to that of the support.

During the thermal treatment allied to the process of deposition of the coating, the quasi-crystalline phase of the material according to the invention does not undergo any transformation: neither increase in particle size nor change in grain structure, and any amorphous phase is converted to the crystalline phase. The coating will, as a consequence, be thermally stable whatever process is used to obtain the material according to the invention.

The quasi-crystalline phases have been identified by X-ray diffraction diagrams. In all these diagrams the rays of negligible intensity have not been indexed.

Figure 1:
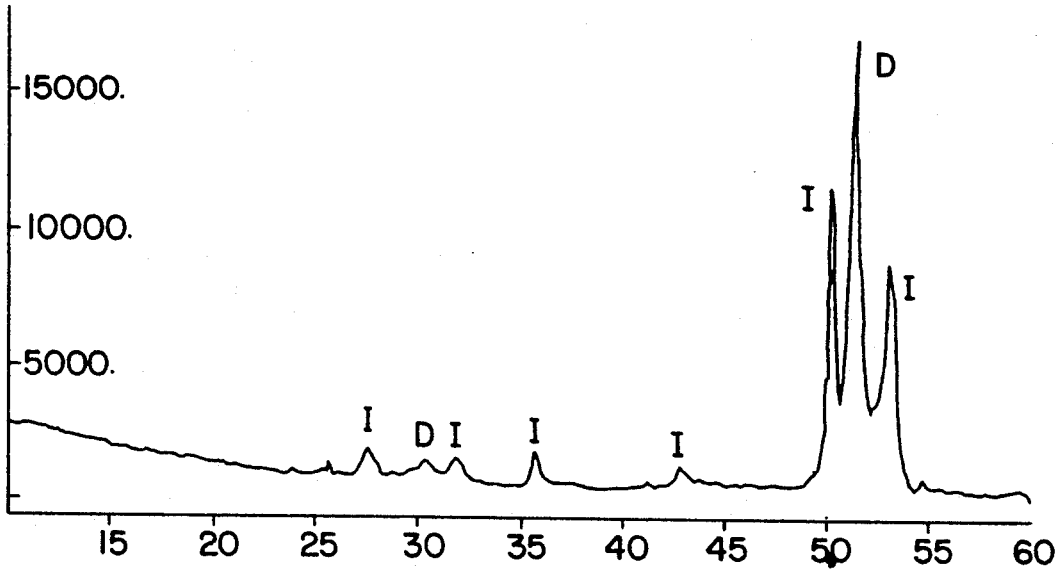
FIGS. 1 to 4 show the X-ray diffraction diagrams of coatings according to the invention.

FIG. 1 represents the X-ray diagram of coating R1. In this figure, "I" designates the rays from the icosahedral phase and "D" the rays from the decagonal phase.

Figure 2:
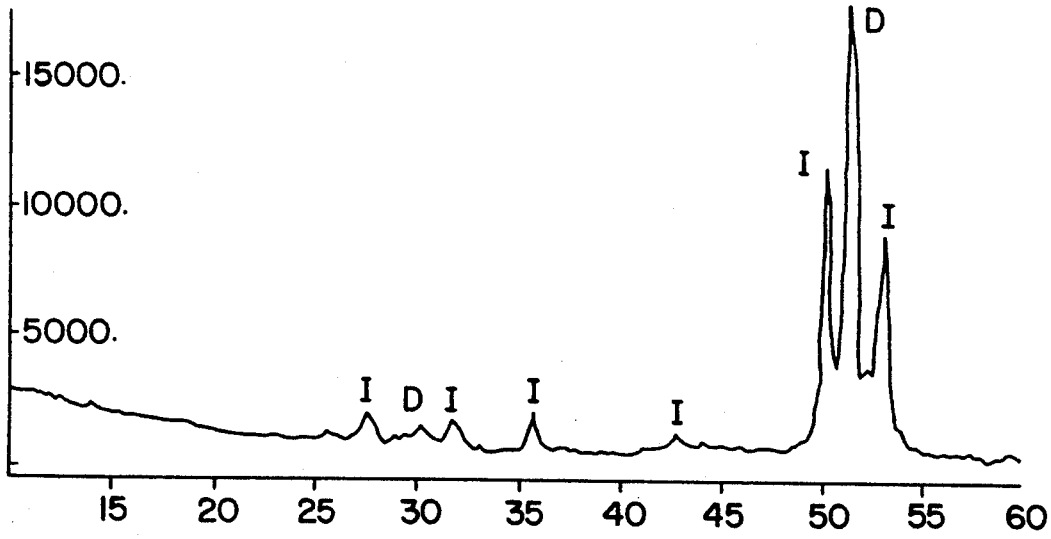

FIG. 2 represents the X-ray diagram of coating R3. "I" and "D" have the same meaning as for FIG. 1.

Figure 3:
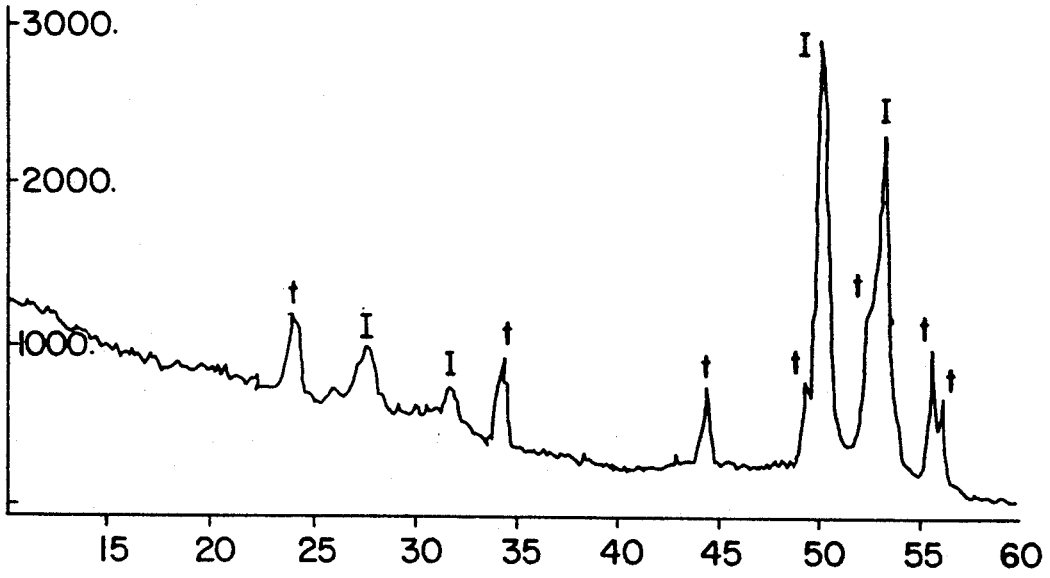

FIG. 3 represents the X-ray diagram of coating R4. In this figure, "I" designates the rays from the icosahedral phase and "t" designates the tetragonal compound $Al_2Cu$. A decagonal phase is no longer observed.

Figure 4:
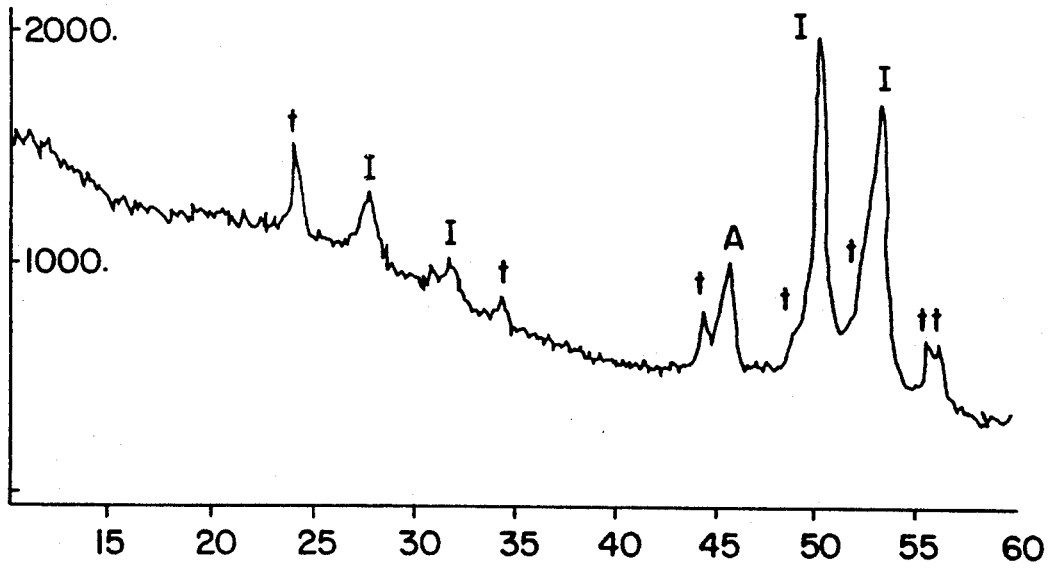

FIG. 4 represents the X-ray diagram of coating R5. In this figure, "I" designates the rays from the icosahedral phase, "t" designates the rays from the tetragoneal compound $Al_2Cu$ and "A" the rays from face-centered cubic aluminium.

The proportion of quasi-crystalline phase corresponds to the ratio of the area under the peaks attributed to the quasi-crystalline phase to the total area under the peaks visible.

The coefficient of friction was determined using curves Ft=F(Fn), defined above. FIGS. 7 and 8 represent this curve for, respectively, the substrate alone and coated substrate R3.

The slope of the curve gives a coefficient of friction of 1.6 for the substrate alone and of 0.5 for R3. For the latter, the slope is modified from point A of the curve: having passed the layer of coating, the indenter has penetrated the substrate and the slope of the curve from this point is equivalent to that of the curve in FIG. 7.

In addition, scanning microscope observations in combination with analyses using the Casting microprobe have allowed the method of cracktesting and the depth of penetration of the indenter during the scratch-resistance test to be determined. Examination of the bottom of the scratch reveals the appearance of intergranular cracks in the deposit according to the invention without notable loss of adhesion of the latter to the substrate.

Determination of an element present in the substrate and absent from the coating (Mn) shows that the coating does not undergo a loss of adhesion to the substrate on either side of the scratch before the normal force Fn attains a sufficient value for the indenter to pass through the coating. The scanning microscopy image in FIG. 10 shows three scratches made in coating R3. In this figure, the total length of one scratch corresponds to 60 N on the abscissa of the curve in FIG. 8. It is deduced that the indenter passes through the coating only in the final third of the scratch. From the point at which the indenter has passed through the coating, a white border is formed on the image which is characteristic of the substrate material displaced by the indenter. The coating is damaged, but not torn off in sheets. These observations confirm that the coatings adhere well to the substrate.

The degree of open porosity was evaluated from scanning microscopy images. FIG. 11 represents the scanning microscopy image of coating R1 (the white portion of the horizontal line at the bottom of the image represents 1 mm) and FIG. 12 that of coating R2 (the white portion of the horizontal line at the bottom of the image represents 0.1 mm).

To determine the degree of open porosity, the area "A" occupied by the particles deposited was measured on a reference surface area "S" of such an image, OP=-1(A/S).

EXAMPLE 3 (COMPARATIVE)

Three materials of the prior art were prepared using the process in Example 1. The compositions of these materials are collated in Table 4.

TABLE 4

| Mat. | Composition |
|---|---|
| M6 | $Al_{78}Cu_{12}Fe_6Mo_1Si_3$ |
| M7 | $Al_{60}Cu_{10}Fe_{30}$ |
| M8 | $Al_{65}Cu_{18}V_{12}Mo_2Si_3$ |

EXAMPLE 4 (COMPARATIVE)

The crude cast materials from Example 3 were deposited on a substrate identical to that used in Example 2, using the process in Example 2. The coated substrates obtained were characterized, and the results are collated in Table 5.

TABLE 5

| Coat. | Mat. | T (μm) | OP | AI | CF | H(Hv30) | OC (% by vol) |
|---|---|---|---|---|---|---|---|
| R8 | M6 | 45 ± 10 | 40% | E | | 380 | 0% |
| R9 | M7 | 40 ± 10 | 40% | E | 0.95 | 400 | 0% |
| R10 | M8 | 40 ± 10 | 45% | E | | 370 | <20% |

Figure 5:
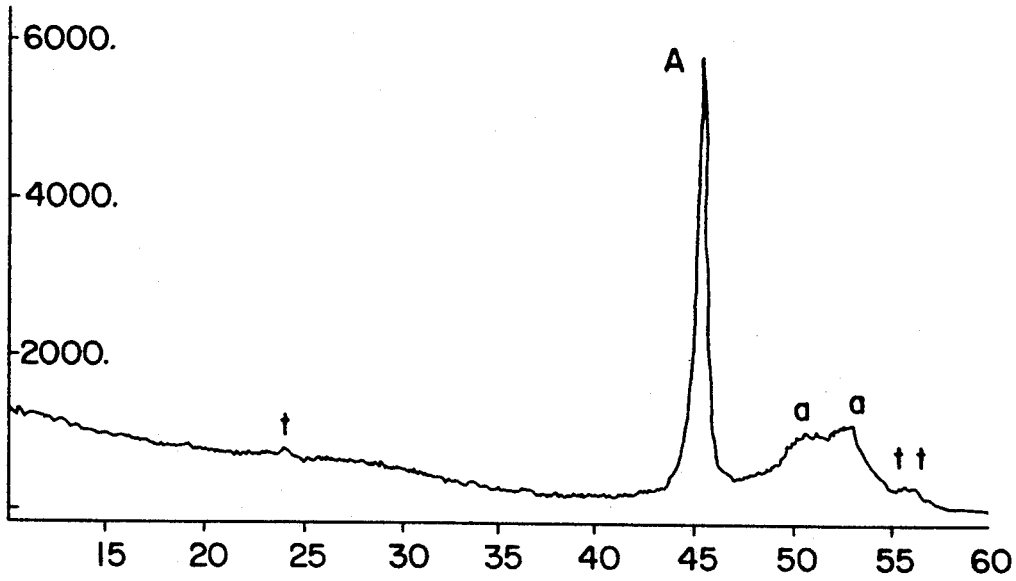
FIGS. 5 and 6 show the X-ray diffraction diagrams of coatings according to the prior art.

According to FIG. 5, which shows the X-ray diagram of coating R8, coating R8 is essentially made up of a mixture of $Al_2Cu$ (t lines), face-centered cubic aluminium (A line) and an indeterminate amorphous or poorly-crystallized compound (a lines). The I rays of the icosahedral phase and the D rays of the decagonal phase do not exist.

Figure 6:
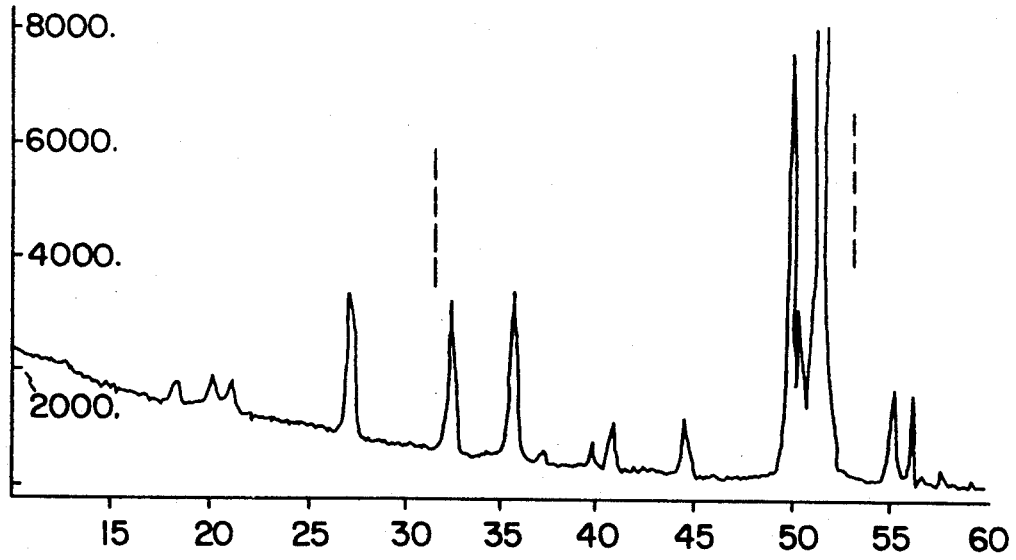

According to FIG. 6, which shows the X-ray diagram of coating R9, R9 comprises, in addition to the low proportion of quasi-crystallized phase, a mixture of $Al_2Cu$ and $Al_3V$. The absence of broadened peaks at $2\theta=31.8°$ and $2\theta=53.9°$ (positions marked by vertical dashes) proves that the icosahedral phase has disappeared.

FIG. 9 shows curve Ft=F(Fn) for coating R9, obtained in the same way as above. It shows that the coefficient of friction of the coating varies between 0.95 and 1.15 between the beginning and the end of the scratch.

EXAMPLE 5

Deposition of Material M1 by Supersonic Jet

Five substrates were prepared by brushing with a metal brush and/or by sand blasting. The powder of material Ml, obtained according to the process in Example 2, was then applied to each of the substrates with a super-sonic jet. The powder was thus accelerated in a high-pressure nitrogen jet to a speed of Mach 10; it was melted by passing through a reducing flame and deposited on the substrates to give coated substrates R11 to R15.

The nature of the substrates and the surface treatment conditions before application of the M1 powder are collated in Table 6 below for each of the coated substrates.

TABLE 6

| Coating | Substrate | Surface State | Size of sand blasting grains |
|---|---|---|---|
| R11 | AU4G | sand blasting | 0.12 mm |
| R12 | AU4G | brushing + sand blasting | 1.6 mm |
| R13 | AU4G | sand blasting | 1.6 mm |
| R14 | AU5GT | brushing + sand blasting | 1.6 mm |
| R15 | AU7GT | sand blasting | 0.12 mm |

Coatings R11 to R15 thus attained adhere perfectly to the substrates. Their open porosity is negligible and their closed porosity less than 15%. This process allows significant thicknesses, in the neighborhood of or greater than 100 μm, to be attained. FIGS. 13*a*, 13*b*, 13*c*, 13*d*, and 13*e* represent the $Hv_{30}$ microhardnesses obtained for, respectively, coated substrates R11, R12, R13, R14 and R15. The microhardness was measured on the edge of the coated substrates, along a straight line perpendicular to the surface of the substrate. It should be noted that certain coated substrates have a surface hardness of greater than 500 kg/mm$^2$.

EXAMPLE 6

Deposition of Materials M9 and M10 on a Substrate

Alloys M9 and M10 from Example 1 were made up and reduced to powder according to the process in Example 2. These alloys were applied to a AU5GT substrate following the operating method of Example 3. The coated substrates obtained, R16 and R17, were used to evaluate the resistance of the coatings to oxidation, and therefore their performances during use in the field of the cooking of food. For this purpose, the coated substrates were first of all mechanically polished to obtain an optical polish, then subjected to isothermal treatments at 300° C. and 400° C., for a period of 30 hours and 144 hours in the air. A plate of uncoated substrate and a plate of 18/8 stainless steel were subjected to the same treatments for comparison.

The optical micrographs of the samples obtained, without subsequent polishing or heat treatment, show that the quasi-crystalline deposits M9 and M10 show no visible degradation of their surface, while substrate AU5GT and the stainless steel show a very clear alteration of their surface. This alteration is due to the formation of oxides, as FIGS. 14 and 15 show. The surface state of the quasi-crystalline deposits M9 and M10 being practically unmodified, the properties which result directly from it, for example the non-stick properties, are preserved.

FIG. 14 represents counts of the number of 25 pulses received on the analyzer of a Casting probe set on the oxygen emission ray, as a function of the length of the thermal treatment, for coated substrates R16 and R17 and for the above-mentioned comparative substrates, the temperature being fixed at 400° C.

FIG. 15 represents counts of the number of pulses received on the analyzer of a Casting probe set on the oxygen emission ray, as a function of the temperature of the heat treatment, for coated substrates R16 and R17 and for the above-mentioned comparative substrates, in 144 hours.

It is clearly shown on these figures that the quasi-crystalline coatings of the present invention resist oxidation better than the comparative substrates of AU5GT alloy and stainless steel, and this more particularly at 400° C.

EXAMPLE 7

Deposition of Material M10 on a Copper Substrate

Alloy M10, made up and reduced to powder as 15 before, was deposited on a plate of metallic copper using a powder torch used in Example 2. This plate had a mean microhardness of $Hv_{30}=50\pm1$ kg/mm$^2$. FIG. 16 shows that the hardness of the deposit, measured on the edge of the coated material R18 obtained, is at least $Hv_{30}=500$ kg/mm$_2$ which corresponds to a gain in hardness of an order of magnitude. The thickness of the deposit after brushing with a metal brush has caused the open porosity of the coating to disappear almost completely. There only remains a closed porosity of 15%.

Comparison of all the characteristics of the coatings according to the invention and the coatings of the prior art, and in particular the adhesion index, the coefficient of friction and the proportion of quasi-crystal in the coatings shows that the choice of materials having a high proportion of quasi-crystalline phase allows better quality coatings to be obtained. Not only do the coatings not mask the good properties of the alloys of the prior art, but in addition they have a good adhesion to the substrate because of the heat stability of their structure.

The coatings according to the invention are appropriate for various uses.

When they are obtained with a significant open porosity, for example greater than 20% by volume, they are particularly useful for applications requiring lubrication. In fact, the lubricating agent filmed over the substrate coated with a material according to the invention impregnates the pores of the coating. When the temperature of the substrate rises during use, liquidation is produced. This property is useful for cooking utensils which are not subjected to washing with detergents. Thus, the coating materials according to the invention are particularly suitable for grill-pans and pancake pans. Their great hardness allows them to be cleaned by scraping, without the necessity to have recourse to detergents.

The materials according to the invention, having a significant porosity, find another worthwhile application in the field of anti-friction bearings.

When their open porosity is low, either as a result of the process of deposition of the coating, or following a surface treatment, the coatings according to the invention are particularly suitable for production of anti-wear surfaces (chassis of air-transported armaments, linings and pistons and iron soles) or for the manufacture of reference surfaces (for example for machine tool tables or for precision apparatus). They are also suitable for various utensils for cooking without fat: for these utensils, the smoother the cooking surface, that is to say the lower the porosity, the less the food will have a tendency to stick during cooking.

EXAMPLE 8

Comparison of Alloys of Present Invention with those Disclosed by LeCaër

U.S. Pat. Nos. 4,595,429 ('429) and 4,710,246 ('246) by LaCaër et al. disclose a very large family of substantially amorphous or microcrystalline aluminum-base alloys which are obtained from the liquid state by very rapid cooling, such as cryogenic cooling. In the '246 patent, the microcrystalline phase is defined as follows:

> The expression of microcrystalline state is used to denote an alloy in which 20% of the volume or more is in a crystallized state and in which the mean dimension of the crystallites is less than 1000 nm, preferably less than 100 nm (col. 2, lines 10–14).

In contrast, the alloys of the present invention are "quasicrystalline," have grain size greater than 1000 nm and have superior thermal stability. The thermal stability of quasicrystalline alloys renders them easy to use because the whole process from master ingot to final coating through flame torch melting, has a negligible effect on the alloys' mechanical properties. Microcrystalline material having grain size below 100 nm or 1000 nm or material which is essentially amorphous would necessarily sustain undesirable grain growth or crystallization when exposed to temperatures required by the coating process of the present application.

In order to demonstrate the difference between the alloys of LaCaër and those of the present invention several comparative experiments were conducted and are summarized below:

New ingots of alloy composition as defined in Table 7 below were prepared according to Example 1 above. Those compositions belong also to the prior art of LeCaër.

TABLE 7

| Alloy reference number | Nominal composition at % |
|---|---|
| 279 | $Al_{69}Cu_{17}Fe_{10}Mo_1Si_3$ |
| 280 | $Al_{72}Cu_{16}Fe_8Mo_1Si_3$ |
| 281 | $Al_{75}Cu_{14}Fe_7Mo_1Si_3$ |

After melting the pure constituents, the ingot was cooled down to room temperature at a rate of about 50C/mn. The resulting structure, as analyzed by X-ray diffraction showed the existence of minority (i.e. less than 40% vol.) crystalline phases ($Al_7Cu_2Fe$ and $Al_2Cu$) and balance of quasicrystalline phases, mainly the icosahedral phase.

Pieces of about 1 $cm^3$ volume broken from these master ingots were annealed in evacuated quartz ampoules for 25h at 800° C. X-ray diffraction demonstrated that the structure of the material was basically unchanged except that the amount of minority phases had decreased: the heat treatment improves the volume fraction of the phases in the present application. Such a heat treatment would have destroyed an essentially amorphous sample. The case of a microcrystalline material is examined below.

FIGS. **17*a*–17*d* present optical micrographies of polished sections of the as-cast material (17*a*) and annealed material (17*b*) of alloy 279. There is essentially no significant grain coarsening of this material for the grain size has already reached a large value during slow solidification from the melt. Accordingly, the Vickers microhardness under 30 grams load keeps basically constant: 440 in the as-cast state and 530 in the annealed state. It is furthermore important to notice that the brittleness of the material is tolerable and rather diminishes with annealing. Consider the pictures of the indentations shown in FIGS. 17*a*–17*d***. The brittleness of the material is manifested by the cracks surrounding the indentation. At 30g load, there is no crack visible. At 400g load, cracking is visible but this is not surprising for such an intermetallic composition.

The same conclusions are reached with alloys 280 and 281. FIGS. **18*a*–18*b* (alloy 280) and 19*a*–19*b* (alloy 281) compare the microstructures observed by optical microscopy in the as-cast (18*a* and 19*a*) and annealed state (18*b* and 19*b***) and present Vickers indentations at 400 g and 30 g load, respectively. Values of the Vickers hardness under 30 g ar as follows: alloy 280: 460 in as-cast state and 410 after annealing; alloy 281: 495 in as-cast state and 390 after annealing.

Again, there is only a small change of the Vickers measurements. The decrease, instead of increase observed with alloy 279, may be related to the presence of a minute amount of Al-Mo intermetallics in those alloys which dissolve upon annealing. Comments about brittleness of the material, as deduced from the Vickers indentations, are as above.

In all cases, the observations made on the materials match the requirements of the present invention: they contain more than 40% of quasicrystalline phase and they fairly well resist a drastic temperature treatment so that they may be used for thermal projection processing and work at appreciable temperature as exemplified in the present application. Grain size in the crystalline phase is greater than 1,000 nm.

Applicants then applied the same experiments to alloys 279–281 as claimed in LeCaër to determine whether the results would be comparable.

Three alloys with nominal composition as indicated above were melt spun according to the method described in LeCaër. The velocity of the wheel was 50m/s and the cooling rate achieved on the order of at least 500.000 K/sec. This technique produced ribbons of about 1 to 2 mm width and thickness in the range 10 to 30 μm mixed up with flakes about 2 mm in diameter.

The microstructure, as revealed by X-ray diffraction, showed that alloy 279 produced a microcrystalline material with very broad lines indicating that the grain size is below 100 nm. Considering the prior art available in 1982, it is likely that this material would not have been identified properly as a quasicrystalline phase. As-cast, this material is extremely brittle and Vickers indentations break the ribbon as FIG. 20 shows. A very rough estimate of the Vickers hardness under 30 g falls between 250 and 350.

Melt spun ribbons of alloys 280 and 281 give Vickers hardness of 310 and 290, respectively. They also appear brittle (FIGS. 21 and 22, respectively, applied load 30 grams). X-ray diffraction measurements on those ribbons show that quasicrystalline phases are actually no longer identifiable, if present, due to the presence of a substantial amount of amorphous phase and too small grain size (see FIG. 23). The lower hardness of the ribbons is assigned to the presence of this amorphous phase. Finally, a small amount of elemental Aluminum and possibly crystalline phases is found in the as-cast ribbons.

To evaluate the thermal stability, the ribbons were submitted to annealing in a DSC calorimeter (heating rate 20C/mn). The DSC traces are shown in FIG. 24. The metastability of all ribbons of alloys 279, 280, and 281 is evident on this figure: an exothermal peak is apparent at T~400C, though more pronounced in the presence of the amorphous phase. For alloy 279, it corresponds to a grain coarsening mechanism. Also, eutectic reactions involving crystalline phases, presumably the crystallization products of the amorphous phase in samples 280 and 281 appear between 500 and 550C which though endothermal would have ruled out alloys 280 and 281 for the application envisaged by the present invention.

Finally, ribbons were annealed in dry air at 550C for 3 hours. The phase content did actually change much and the specimens appeared dramatically embrittled. The Vickers hardness under 30 grams load reached values of 320, 640 and 470 for samples 279, 280, and 281, respectively.

Altogether, rapidly solidified materials of alloys of those specific compositions of LaCaër would have been rejected for the purpose of processing methods and applications exemplified in the present invention because of brittleness in the as-cast state and inability to resist heat treatment of the sort corresponding to the claims of the present application. In contrast, bulk ingots, slowly solidified from the melt according to classical metallurgical techniques as well as powdered materials produced thereof and sprayed to form a coating match the specifications of the present invention.

EXAMPLE 9

Various samples of bulk alloys whose composition is given in Table 8 below were produced by melting pure elements in a high-frequency field under an argon atmosphere in a cold copper crucible. The total mass thus produced was between 50 g and 100 g of alloy. The melting temperature, which depends on the composition of the alloy is within the temperature range situated between 950° and 1200° C. While the alloy was kept molten, a solid cylindrical specimen 10 ±0.5 mm in diameter and a few cm in height was formed by drawing liquid metal into a quartz tube. The rate of cooling of this sample was in the region of 250° C. per second. This sample was then cut up with a diamond saw to obtain cylindrical specimens approximately 3 mm in thickness. The opposite faces of each cylinder were polished mechanically under water, great care being taken to ensure they were parallel. The structural state of the specimens was determined by X-ray diffraction and by electron microscopy. All the samples selected (samples 1 to 4) contained at least 90% by volume of quasi-crystalline phase according to the definition given above.

EXAMPLE 10

The thermal diffusivity $\alpha$, the specific mass $\rho$ and the specific heat $C_p$ were determined in the region of room temperature for the samples prepared above.

The thermal conductivity is given by the product $\lambda = \alpha \rho C_p$.

The thermal diffusivity $\alpha$ was determined with the aid of a laboratory device combining the laser flash method with an Hg-Cd-Te semiconductor detector. The laser was employed to provide power pulses between 20 J and 30 J of a duration of $5 \times 10^{-4}$s to heat the front face of the specimen, and the semiconductor thermometer was used to detect the thermal response on the opposite face of the specimen. The thermal diffusivity was deduced from the experiments by the method described in A. Degiovanni, High Tem. —High Pressure, 17 (1985) 683.

The specific heat of the alloy was determined in the temperature range 20°-80° C. with a Setaram scanning calorimeter.

The thermal conductivity $\lambda$ is deducted from the two preceding measurements and the knowledge of the specific mass of the alloy, which was measured by Archimedes' method by immersion in butyl phtalate maintained at 30° C. (±0.1° C.).

The values obtained are reported in Table 8. By way of comparison, this table contains the values relating to some materials of the prior art, some of which are known as a heat barrier (samples 5 to 8).

TABLE 8

| | Composition | $m^2 3^{\alpha-1} \times 10^6$ | $\rho$ kg $m^{-3}$ | $C_p$ J $Kg^{-1}$ $K^{-1}$ | $\lambda = \alpha \rho C_p$ W $Kg^{-1}$ $K^{-1}$ | Predominant phase Volume I |
|---|---|---|---|---|---|---|
| 1 | $Al_{65.5}Cu_{18.5}Fe_8Cr_8$ | 1.05 | 4300 | 620 | 2.8 | 100% O/D |
| 2 | $Al_{65}Cu_{20}Fe_{10}Cr_5$ | 1.55 ± 0.1 | 4260 ± 150 | 680 | 4.5 | 100% O/D |
| 3 | $Al_{63.5}Cu_{24}Fe_{12.5}$ porosity of 3% | 0.85 ± 0.02 | 3950 ± 200 | 600 | 2 | 100% R/I |
| 4 | $Al_{63.5}Cu_{24}Fe_{12.5}$ porosity of 8% | 0.50 ± 0.02 | 3700 ± 200 | 590 | 1.1 | 100% R/I |
| 5 | Al fcc | 90-100 | 2700 | 900 | 230 | |
| 6 | $Al_2O_3$ | 8.5 | 3800 | 1050 | 34 | |
| 7 | Stainless steel | 4 | 7850 | 480 | 15 | |
| 8 | $ZrO_2$—$Y_2O_3$ 8% | 0.8 | 5700 | 400 | 2 | |
| 9 | $Al_6Mn$ | 5.4 | | | | |
| 10 | $Al_{13}Si_4Cr_{14}$ | 7.4 | | | | |

TABLE 8-continued

| | Composition | $m^2 3^{\alpha-1} \times 10^6$ | $\rho$ kg $m^{-3}$ | $C_p$ J $Kg^{-1}$ $K^{-1}$ | $\lambda = \alpha \rho C_p$ W $Kg^{-1}$ $K^{-1}$ | Predominant phase Volume I |
|---|---|---|---|---|---|---|
| 11 | $Al_3Ti_2Cu$ | 7.0 | | | | |
| 12 | $Al_7Cu_2Fe$ | 6.2 | | | | |
| 13 | $Al_2Cu$ | 14–17 | | | | |

In this table the symbols in the last column have the following meaning:

O: Orthorhombic approximating compositions (C. Dong, J.M. Dubois, *J. Materials Science*, 26 (1991), 1647).

D: Decagonal phase (L. Bendersky, Quasicrystal with One Dimensional Translational Symmetry and a Tenfold Rotation Axis, *Physical Review* Letters, Vol. 55, No. 14, 1985, pages 1461–1463).

R: Rhombohedral approximating composition (M. Audier and P. Guyot, 3rd Int. Meeting on Quasicrystals, eds. J. Yacaman, World Scientific, Singapore, 1990).

I: Phase icosahric (D. Shechtman, I. Blech, D. Gratias, J.W. Cohn, Metallic Phase with long-range Orientational Order and No Translational Symmetry, *Physical Review Letters*, Vol 53, No. 20, 1984, pages 1951–1953).

From these results it appears that, at room temperature, the thermal conductivity of the quasi-crystalline alloys forming the components for protecting against heat of the present invention (samples 1 to 4) is considerably lower than that of the metallic materials (aluminum metal or tetragonal $Al_2Cu$) which are given by way of comparison. It is two orders of magnitude lower than that of aluminum and one order of magnitude lower than that of stainless steel, usually considered to be a good heat insulator. Moreover, it is lower than that of alumina and wholly comparable with that of $Y_2O_3$-doped zirconia, considered as the archetype of the heat insulators in industry.

By way of comparison, the diffusivity of alloys 9 to 13 was determined. These alloys, which form definite aluminum compounds, have compositions close to those of the quasi-crystalline alloys which can be employed for the protective components of the present invention. However, they do not have the quasi-crystalline structure defined above. In all cases, their thermal diffusivity is higher than $5\times10^{-6}$ $m^2/s$, that is to say much higher than that of the alloys adopted in the case of the present invention.

EXAMPLE 11

The values of $\alpha$ have been plotted as a function of the temperature up to 900° C.

The measurement of thermal diffusivity was carried out by the method of Example 10. Each specimen was placed under a purified argon stream in the center of a furnace heated by the Joule effect; the rate of temperature rise, programmed by a computer, varied linearly at a rate of 5° C./min. All the samples in accordance with the present invention exhibit an approximately linear increase in $\alpha$ with temperature. The value of $\alpha$ determined at 700° C. is close to being double that measured at room temperature. Similarly, the specific heat increases with temperature and reaches 800 to 900 J/kg K at 700° C. The specific mass decreases by the order or 1 to 2% as shown by measurements of thermal expansion or of neutron scattering. Consequently thermal conductivity remains lower than 12 W/m K, that is to say lower than the thermal conductivity of stainless steels which are employed for some thermal insulation applications. In the case of some alloys, however, much better performance is observed: for example in the case of the alloy $Al_{63.5}Cu_{24}Fe_{12.5}$ (alloy 3), $\lambda$ is 3.2 W/m K at 700° C.

FIGS. 25 and 26 show, respectively, the change in $\alpha$ as a function of temperature for different materials under the following conditions:

FIG. 25 shows the measurements recorded on heating the alloy $Al_{65}Cu_{20}Fe_{10}Cr_5$ (alloy 2) are shown using black squares, those recorded on cooling using white squares.

FIG. 26 shows heating in the case of the alloy $Al_{63.5}Cu_{24}Fe_{12.5}$ (alloy 4) in the state of a rhombohedral approximating composition (a) and of icosahedral phase (b). Above 860° C. the alloy is transformed into a mixture of crystalline phases, hence the increase in $\alpha$, and then melts at about 950° C.

FIG. 27 shows a sample of the copper cylinder type comprising a coating 2 and provided with a central thermocouple 3 and a side thermocouple 4, both being inserted as far as midway of the length of the cylinder.

FIG. 28 shows a hollow tube 5 through which a stream of hot air 6 is passed and which is provided with three thermocouples, $T_1$, $T_2$ and $T_3$, respectively.

FIG. 29 shows the change in the surface temperature of each of the samples, A0, A1 and A2 as a function of time.

EXAMPLE 12

The variation in the thermal expansion of the alloy $Al_{63.5}Cu_{24}Fe_{12.5}$ was measured. From the thermal expansion curve it can be seen that the expansion coefficient shows little dependence on temperature and has a value of $8\times10^{-6}$/° C., a value close to those for stainless steels.

EXAMPLE 13

The superplastic behavior of some alloys capable of forming the components for protecting against heat of the present invention was studied. Cylindrical specimens 4 mm in diameter and 10 mm in length, with accurately parallel faces, were produced by the same method as those of Example 9 with the alloy $Al_{63.5}Cu_{24}Fe_{12.5}$. These specimens were subject to mechanical tests in compression on an Instron machine. Tests were performed up to a load of 250 MPa, at a beam travel speed of 50 μm/min, the temperature being kept constant between 600° and 850° C. The alloy shows a superplastic behavior from 600° C. upwards.

EXAMPLE 14

Production of components for protecting against heat according to the invention and according to the prior art.

A first series of samples was produced. The substrate was a solid copper cylinder with a diameter of 30 mm and a height of 80 mm and the coating was applied with a plasma torch by a conventional method. Sample C0 is the uncoated copper cylinder. Sample C1 was coated over its whole surface with a 1-mm thick layer of the alloy $Al_{65.5}Cu_{18.5}Fe_8Cr_8$ (alloy 1). Sample C6 comprises a layer of a material forming the component for protecting against heat of the present invention used as a bonding layer and an yttriated zirconia layer. Samples C3 and C4, used for comparison comprise a zirconia layer and an alumina layer respectively. Another series of samples was produced using, as support, a stainless steel tube 50 cm in length, 40 mm in diameter and with a wall thickness of 1 mm (samples A0 to A2). In each case the support tube was coated at one of its ends over a length of 30 cm. In this latter case the deposits were applied with an oxygen-gas torch, except in the case of the zirconia deposit on sample A2, which was applied with the plasma torch. Table 9 below gives the identity and the thickness of the layers for the various samples. The accuracy of the final thicknesses of the deposits was ±0.3 mm.

All the samples were provided with Chromel-Alumel thermocouples of very low inertia. FIG. 27 shows a sample of the copper cylinder type 1 comprising a coating 2 and provided with a central thermocouple 3 and a side thermocouple 4, both being inserted as far as midway of the length of the cylinder. FIG. 28 shows a hollow tube 5 through which a stream of hot air 6 is passed and which is provided with three thermocouples shown as T1, T2 and T3 respectively, the first two being inside the tube and placed at the beginning of the coated zone and at the end of the coated zone respectively, and the third being on the surface of the coating.

EXAMPLE 15

Use of the protective components as protection with regard to a flame.

Samples C0, C1, C3 and C8 were placed on their bases on a refractory brick. Successive heat pulses of 10-s duration were applied to each specimen at intervals of 60 s and the response of the thermocouples was recorded. These pulses were produced by the flame of a torch placed at a uniform distance from the sample and directed facing the thermocouple close to the surface. The flowrate of the combustion gases was carefully monitored and kept constant throughout the experiment. Two series of experiments were conducted: one with specimens initially at 20° C. and the other with specimens initially at 650° C.

Sample CO makes it possible to define three parameters which summarize the results of the experiment, namely the maximum temperature difference P between the two thermocouples, the rate of temperature rise $\Delta T/\Delta t$ of the side thermocouple 4 during the pulse and the temperature increase $\Delta T$ produced in the center of the specimen (thermocouple 3). These data appear in Table 9. From these results it can be seen that the protective components of the present invention, employed as a heat barrier, exhibit performances which are at least equivalent to those of zirconia.

In samples C6 and A2 the components for protecting against heat of the present invention form a primer layer. It was found that the zirconia layer of sample C3 did not withstand more than three heat pulses and was fissured from the first pulse onwards. In the case of sample C6, also subjected to a series of heat pulses, the surface temperature of the zirconia deposit, measured by a third thermocouple place in contact with the deposit at the end of the tests, stabilized at 1200° C. The experiment involved 50 pulses and the sample C6 withstood it without any apparent damage, even though the coefficient of expansion of copper is approximately twice that of the quasi-crystalline alloy, which would imply appreciable shear stresses at the substrate/deposit interface if the primer material did not become plastic. The components for protecting against heat of the present invention are therefore well-suited for the production of bonding primers, in particular for heat barriers.

TABLE 9

| | | 20–100° C. | | | 650–550° C. | | |
|---|---|---|---|---|---|---|---|
| | Coating material | ΔT ± 0.5° C. °C. | ΔT/Δr °C./s | P ± 0.5° C. °C. | ΔT ± 0.5° C. °C. | ΔT/Δt °C/a | P ± 0.5° C. °C. |
| C0 | None | 27 | 2.85 | 5.4 | 22 | 2.3 | <1 |
| C1 | $Al_{65.5}Cu_{18.5}Fe_8Cr_8$ 1 mm | 25 | 2.7 | 3.8 | 11 | 1.1 | 6 |
| C6 | $Al_{65.6}Cu_{18.5}Fe_8Cr_8$ 0.5 mm $ZrO_2$—$Y_2O_3$ 8% 1 mm | 24 | 2.6 | 4.0 | 13 | 1.0 | 2.5 |
| C3 | Zirconia 1 mm | 24 | 2.75 | 4.7 | 14 | 1.5 | 2.3 |
| C4 | Alumina 1 mm | 27 | 2.7 | 6.5 | 25 | 3.0 | 8.2 |
| A0 | None | — | — | — | — | — | — |
| A1 | $Al_{65.5}Cu_{18.5}Fe_8Cr_8$ 1.5 mm | — | — | — | — | — | — |
| A2 | $Al_{65.5}Cu_{18.5}Fe_8Cr_8$ 0.3 mm $ZrO_2$—$Y_2O_3$ 8% 1.2 mm | — | — | — | — | — | — |

EXAMPLE 16

Application of a component for protecting against heat of the present invention to the insulation of a jet engine.

Samples A0 and A1 were employed to evaluate the ability of the alloys of the invention to insulate a device thermally. A comparison was made in relation to the properties of the zirconia barrier provided with a bonding layer (sample A2). Each of the samples was provided with three thermocouples T1, T2 and T3 as shown in FIG. 28. A stream of hot air at a constant flow rate was sent through the stainless steel tube forming the substrate of each sample. The air temperature at the entry, measured with the aid of thermocouple T1, was 300°±2° C. The surface temperature, measured with the aid of thermocouple T3, was recorded as a function of time starting with the switching-on of the hot-air generator. Thermocouple T2 made it possible to confirm that the transitory conditions for establishing the hot-air flow were identical in the case of all the measurements.

FIG. 29 shows the change in the surface temperature of each of the samples A0, A1 and A2 as a function of time. The surface temperature of sample A0 (without coating) at equilibrium exceeds that of the zirconia sample by approximately 35° C. The components for protecting against heat of the present invention give results which are close to that of the zirconia layer, since a temperature difference of only 10° C. is measured between sample Al (quasi-crystalline coating) and sample A2 (zirconia coating used as reference).

Numerous modifications and variations of the invention as described and illustratively exemplified above are expected to occur to those skilled in the art.

What is claimed is:

1. An aluminium alloy coating material comprising a composition (a) having the general formula $Al_aCu_bFe_cX_dI_e$ wherein X represents one or more elements chosen from V, Mo, Ti, Zr, Nb, Cr, Mn, Ru, Rh, Ni, Mg, W, Si and the rare earths, I represents the inevitable manufacturing impurities, $e \leqq 2$, $14b \leqq 30$, $7 \leqq c \leqq 20$, $0 \leqq d \geqq 10$, with $c+d \geqq 10$ and $a+b+c+d+e=100\%$ of the number of atoms; and (b) containing at least 40% by mass of a quasi-crystalline phase, wherein the mean grain size of the crystallites in the crystalline phase is greater than 1000 nm.

2. The material as claimed in claim 1, wherein the quasi-crystalline phase is an icosahedral phase.

3. The material as claimed in claim 1, wherein the quasi-crystalline phase is a decagonal phase.

4. A substrate coated with a material as claimed in claim 1.

5. The substrate as claimed in claim 4, wherein the coating has an open porosity greater than 20%.

6. The substrate as claimed in claim 4, wherein the coating material has been deposited in vapor phase.

7. The substrate as claimed in claim 4, wherein the coating has an open porosity less than or equal to 20%.

8. The substrate as claimed in claim 7, wherein the coating material has been applied by supersonic jet.

9. The substrate as claimed in claim 7, wherein the coating has been obtained by treatment of a surface of a first coating having an open porosity greater than 20%.

10. The substrate as claimed in claim 9, wherein the treatment is shot blasting.

11. The substrate as claimed in claim 9, wherein the treatment is polishing.

12. The substrate as claimed in claim 9, wherein the treatment is surface melting.

13. A method of manufacturing a cooking utensil comprising coating the utensil with an aluminum alloy coating material comprising a composition (a) having the general formula $Al_aCu_bFe_cX_dI_e$ wherein X represents one or more elements chosen from V, Mo, Ti, Zr, Nb, Cr, Mn, Ru, Rh, Ni, Mg, W, Si and the rare earths, I represents the inevitable manufacturing impurities, $e \leqq 2$, $14 \leqq b \leqq 30$, $7 \leqq c \leqq 20$, $0 \leqq d \leqq 10$, with $c+d \geqq 10$ and $a+b+c+d+e=100\%$ of the number of atoms; and (b) containing at least 40% by mass of a quasi-crystalline phase, wherein the mean grain size of the crystallites in the crystalline phase is greater than 1000 nm.

14. A method of manufacturing anti-friction bearings comprising coating the anti-friction bearings with an aluminum alloy coating material comprising a composition (a) having the general formula $Al_aCu_bFe_cX_dI_e$ wherein X represents one or more elements chosen from V, Mo, Ti, Zr, Nb, Cr, Mn, Ru, Rh, Ni, Mg, W, Si and the rear erths, I represents the inevitable manufacturing impurities, $e \leqq 2$, $14 \leqq b \leqq 30$, $7 \leqq c \leqq 20$, $0 \leqq d \leqq 10$, with $c+d \geqq 10$ and $a+b+c+d+e=100\%$ of the number of atoms; and (b) containing at least 40% by mass of a quasi-crystalline phase, wherein the means grain size of the crystallites in the crystalline phase is greater than 1000 nm.

15. A method of manufacturing an anti-wear surface comprising coating the anti-wear surface with an aluminum alloy coating material comprising a composition (a) having the general formula $Al_aCu_bFe_cX_dI_e$ wherein X represents one or more elements chosen from V, Mo, Ti, Zr, Nb, Cr, Mn, Ru, Rh, Ni, Mg, W, Si and the rare earths, I represents the inevitable manufacturing impurities, $e \leqq 2$, $14 \leqq b \leqq 30$, $7 \leqq c \leqq 20$, $0 \leqq d \leqq 10$, with $c+d \geqq 10$ and $a+b+c+d+e=100\%$ of the number of atoms; and (b) containing at least 40% by mass of a quasi-crystalline phase, wherein the mean grain size of the crystallites in the crystalline phase is greater than 1000 nm.

16. A method of protecting a substrate against heat comprising depositing onto the surface of the substrate an aluminium alloy coating material comprising a composition (a) having the general formula $Al_aCu_bFe_cX_dI_e$ wherein X represents one or more elements chosen from V, Mo, Ti, Zr, Nb, Cr, Mn, Ru, Rh, Ni, Mg, W, Si and the rare earths, I represents the inevitable manufacturing impurities, $e \leqq 2$, $14 \leqq b \leqq 30$, $7 \leqq c \leqq 20$, $0 \leqq d \leqq 10$, with $c+d \geqq 10$ and $a+b+c+d+e=100\%$ of the number of atoms; and (b) containing at least 40% by mass of a quasi-crystalline phase, wherein the mean grain size of the crystallites in the crystalline phase is greater than 1000 nm.

17. The method of claim 16, wherein the depositing is performed by thermal deposition.

18. The method of claim 16, wherein the quasi-crystalline material comprises at least 80% by volume of at least one quasi-crystalline phase.

19. The method of claim 16, wherein the quasi-crystalline material has a porosity of more than 10%.

20. The method of claim 16, wherein protection against heat occurs at temperatures below 800° C.

21. The method of claim 16, wherein the quasi-crystalline material contains stabilizing elements in a concentration of less than 2% based on the number of atoms selected from the group consisting of W, Zr, Ti, Rh, Nb, Hf and Ta.

22. The method of claim 16, wherein the quasi-crystalline material is deposited on the substrate in the form of an intermediate bonding layer between a support and a heat barrier.

23. The method of claim 22, wherein the intermediate bonding layer is comprised of alternating layers of the quasi-crystalline material and a different material which is a heat conductor.

* * * * *

UNITED STATES PATENT AND TRADEMARK OFFICE

CERTIFICATE OF CORRECTION

PATENT NO. : 5,204,191

DATED : April 20, 1993

INVENTOR(S) : Jeane-Marie DUBOIS et al.

It is certified that error appears in the above-identified patent and that said Letters Patent is hereby corrected as shown below:

Column 8, lines 47-48, the heading of the last column in the table reading "OC" should read --QC--

Column 10, lines 60-61, the heading of the last column in the table reading "OC" should read --QC--

Columns 15-16, lines 55-59, and,

Columns 17-18, lines 2-5, the headings of the columns in the table reading

| | Composition | $m^2 3^{s-1} \times 10^6$ | $\rho$ kg $m^{-3}$ | $C_p$ J $Kg^{-1}$ $K^{-1}$ | $\lambda = \alpha \rho C_p$ W $Kg^{-1}$ $K^{-1}$ | Predominant phase Volume I |
|---|---|---|---|---|---|---|

should read

| | Composition | $\alpha$ $m^2 s^{-1} \times 10^6$ | $\rho$ kg $m^{-3}$ | $C_p$ J $kg^{-1}$ $K^{-1}$ | $\lambda = \alpha \rho C_p$ W $kg^{-1}$ $K^{-1}$ | Predominant phase Volume % |
|---|---|---|---|---|---|---|

Column 17, line 23, delete "Phase icosahric" and insert --Icosahedral Phase--;

line 24, delete "long-" and insert --Long--;
line 25, delete "range" and insert --Range--.

UNITED STATES PATENT AND TRADEMARK OFFICE

CERTIFICATE OF CORRECTION

PATENT NO. : 5,204,191

DATED : April 20, 1993

INVENTOR(S) : Jean-Marie DUBOIS, ET AL.

It is certified that error appears in the above-identified patent and that said Letters Patent is hereby corrected as shown below:

Column 20, lines 34-38, the headings of the columns in the table reading

| | Coating material | ΔT ± 0.5 °C. °C. | ΔT/Δr °C./s | P ± 0.5 °C. °C. | ΔT ± 0.5°C. °C. | ΔT/Δt °C/s | P ± 0.5° C. °C. |
|---|---|---|---|---|---|---|---|

should read

| | Coating material | ΔT ±0.5°C °C | ΔT/Δt °C/s | P ±0.5°C °C | ΔT ±0.5°C °C | ΔT/Δt °C/s | P ±0.5°C °C |
|---|---|---|---|---|---|---|---|

Claim 14, line 8, delete "rear erths" and insert --rare earths--.

Signed and Sealed this

Fifth Day of April, 1994

Bruce Lehman

BRUCE LEHMAN

*Commissioner of Patents and Trademarks*

*Attest:*

*Attesting Officer*